US007034797B2

(12) United States Patent
Maki

(10) Patent No.: US 7,034,797 B2
(45) Date of Patent: Apr. 25, 2006

(54) DRIVE CIRCUIT, ELECTRO-OPTICAL DEVICE AND DRIVING METHOD THEREOF

(75) Inventor: Katsuhiko Maki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 368 days.

(21) Appl. No.: 10/455,652

(22) Filed: Jun. 5, 2003

(65) Prior Publication Data

US 2004/0017341 A1 Jan. 29, 2004

(30) Foreign Application Priority Data

Jun. 10, 2002 (JP) ..... 2002-168116

(51) Int. Cl.
*G09G 3/36* (2006.01)

(52) U.S. Cl. ..... 345/100

(58) Field of Classification Search ..... 345/100
See application file for complete search history.

(56) References Cited

U.S. PATENT DOCUMENTS 5,831,588 A * 11/1998 Hotto ..... 345/100
2002/0008686 A1* 1/2002 Kumada et al. ..... 345/94

FOREIGN PATENT DOCUMENTS

GB 2325329 A * 11/1998
JP 1-92797 4/1989
JP 4-52684 2/1992
JP 5-323911 12/1993
JP 7-28031 1/1995
JP 9-54309 2/1997
JP 10-319924 12/1998
JP 2000-20028 1/2000
JP 2002-41004 2/2002

* cited by examiner

*Primary Examiner*—Sumati Lefkowitz
*Assistant Examiner*—Ke Xiao
(74) *Attorney, Agent, or Firm*—Mark P. Watson

(57) ABSTRACT

A drive circuit is provided that can drive a display panel with low power consumption, and an electro optical device including the drive circuit and its drive method are included. Switching signals RSEL, GSEL, and BSEL for demultiplexing are produced so as to control turning switching elements DSWR, DSWG, and DSWB for demultiplexing on and off, which separate data signal where R, G, and B are multiplexed and transmitted. An overlapped period, for periods of activating RSEL, GSEL, and BSEL is set between the timing of changing polarity of common voltage and the timing of assuring writing data signal to a pixel electrode. A drive circuit includes a reference voltage production circuit and a digital to analog conversion circuit and an output circuit, which outputs a programmed voltage (a reference voltage having the same phase as the common voltage) during the overlapped period. The first reference voltage production circuit includes plurality of operational amplifiers and the first and second voltage division circuits.

13 Claims, 26 Drawing Sheets

DRIVE CIRCUIT (DATA LINE DRIVE CIRCUIT)

SWITCHING SIGNAL PRODUCTION CIRCUIT

REFERENCE VOLTAGE PRODUCTION CIRCUIT

REFERENCE VOLTAGE PRODUCTION CIRCUIT

DRIVE CIRCUIT, ELECTRO-OPTICAL DEVICE AND DRIVING METHOD THEREOF

BACKGROUND OF THE INVENTION

1. Field of the Invention

The present invention relates to a drive circuit, an electro-optical device and a drive method.

2. Description of the Related Art

Conventionally, it is well known to use a liquid crystal panel using a simple matrix system or a liquid crystal panel using an active matrix system with thin film transistors (TFT) as a liquid crystal panel used for an electronic device such as a mobile phone.

A simple matrix system has the advantage of providing a panel with lower power consumption but the disadvantage of difficulty in realizing a multicolor display and/or motion picture display. On the other hand, an active matrix system has the advantage of ease in realizing a multicolor display and/or motion picture display but the disadvantage of difficulty in providing a panel with low power consumption.

Recently, in the area of mobile type electronic equipment such as mobile phones, demand has increased for a multicolor display and/or motion picture display that provides a high quality image. Hence, a liquid crystal panel using an active matrix system has been gradually replaced with a liquid crystal panel using a simple matrix system in products for the general public.

Incidentally, in a liquid crystal panel of an active matrix system, an operational amplifier of voltage follower junction, which functions as an impedance conversion circuit, is installed in the output circuit of the data line drive circuit that drives data lines of a display panel. If such operational amplifier is installed in an output circuit, it is possible to suppress voltage drift of data line to a minimum so as to set desired gray-scale voltage of the data line in a short time.

However, when an operational amplifier is installed in an output circuit, there is a problem of increasing wastefully consumed current, namely large consumption of current. In particular, the number of the operational amplifiers is equivalent to the number of data lines. Therefore, when power consumption of each operational amplifier increases, power consumption of data line drive circuits is increased by the number of these operational amplifiers, which adds to the problem of excess power consumption.

In view of the above-mentioned technical issue, the present invention is intended to provide a drive circuit for a display panel with low power consumption, an electro-optical device including the drive circuit and a method of driving the drive circuit.

SUMMARY OF THE INVENTION

An embodiment of the present, invention includes a drive circuit for driving a display panel comprising: a plurality of pixels; a plurality of scanning lines; a plurality of multiplexed data lines each transmitting data signals for one of first, second, and third color components; a plurality of first, second, and third switching elements for demultiplexing, one end of each of the plurality of first, second, and third switching elements being connected to each of the plurality of multiplexed data lines and the other end being connected to each of the plurality of pixels for the first, second, and third color components; and a switching signal production circuit that produces first, second and third switching signals for demultiplexing, and that controls turning on and off of the plurality of first, second, and third switching elements;

the switching signal production circuit producing the first, second and third switching signals for demultiplexing to create first, second, and third activation periods, respectively, for the first, second, and third color components, respectively; the first, second, and third activation periods overlapping for an overlapped period.

In the present invention, the first, second, and third switching signals for demultiplexing, which control turning the first, second and third switching elements on and off are produced. The overlapped period is during the periods of activating the first, second and third switching signals for demultiplexing (the period of activating at least two switching signals together). Hence, according to the present invention, it is possible to apply voltage (electric charging or discharging) to each of the pixels (pixel electrodes) for the first, second, and third color components connected to the first, second, and third switching elements for demultiplexing by using such overlapped period, enabling drift of data line voltage (pixel electrode voltage) to be minimized thereby.

Here, activating a switching signal means that a switching element that is controlled to be on/off by the switching signal is on.

Further, the switching signal production circuit producing the first, second and third switching signals for demultiplexing so that said overlapped period is between the timing of changing the polarity of voltage applied to a pixel electrode provided with each pixel of a display panel and an opposite electrode that sandwiches electro optical material therebetween, and the timing of assuring writing of a data signal to the pixel electrode.

Thus, it is possible thereby to set a desirable voltage applied to a pixel electrode before the timing of assuring writing of data signal into a pixel. The timing of assuring writing of data signal into a pixel means, for example, the timing of turning the first, second, and third switching elements for demultiplexing (at least one switching element) off after turning them on, or turning switching elements for pixels off.

Further, the present invention may comprise a reference voltage production circuit that produces a plurality of reference voltages; a digital to analog conversion circuit that converts digital gray scale data to analog gray scale voltage using the plurality of reference voltages; an output circuit that outputs the analog gray scale voltage from the digital to analog conversion circuit to the data line; and the output circuit outputting a programmed voltage to the data line in the overlapped period.

Hence, drift of data line voltage (pixel electrode voltage) can be suppressed so as to set the data line voltage as a desirable voltage during a short time period.

Further, according to the present invention, the output circuit may include the first, second and third switching elements for multiplexing, one end of each being connected to the data line, the other end of each receiving analog gray scale voltage for the first, second and third color components, respectively, from the digital to analog conversion circuit; and the switching signal production circuit producing the first, second, and third switching signals for multiplexing to control turning the first, second and third switching elements on and off and activating at least one of the first, second, and third switching signals for multiplexing during the overlapped period.

Thus, it is possible to set data line voltage (pixel electrode voltage) as a reference voltage during the overlapped period.

Further, according to the present invention, the output circuit may output an output voltage to the data line during the overlapped period, the phase of the output voltage being the same as the phase of the voltage applied to a pixel electrode provided with each pixel of a display panel and an opposite electrode that sandwiches electro optical material therebetween.

Thus, it is possible to set the data line voltage (pixel electrode voltage) with the same phase as the opposite electrode voltage during the overlapped period.

Further, according to the present invention, the output circuit may include the first, second and third switching elements for multiplexing, one end of each being connected to the data line, the other end of each receiving analog gray scale voltage for the first, second, and third color components, respectively, from the digital to analog conversion circuit; and first, second, and third voltage switching elements for applying voltage, one end of each receiving voltage having the same phase as voltage applied to the opposite electrode, and the other end of each being connected to the other end of each of the first, second and third switching elements for multiplexing, respectively.

Thus, the data line voltage can be set to a voltage having the same phase as an opposite electrode voltage. In addition, a partial display can be available by using these first, second, and third switching elements for applying voltage.

Further, the present invention may comprise a reference voltage production circuit that produces a plurality of reference voltages; a digital to analog conversion circuit that converts digital gray scale data into analog gray scale voltage using the plurality of reference voltages; and an output circuit that outputs analog gray scale voltage from the digital to analog conversion circuit to the data line, wherein; the reference voltage production circuit includes: a first voltage division circuit that includes a ladder resistor with a plurality of resistance elements connected in series, and outputs M voltages to M voltage division terminals in the ladder resistor ($M \geqq 2$); and M impedance conversion circuits that input each of the M voltages from the first voltage division circuit to each of a plurality of input terminals and output voltages for producing reference voltages to each of a plurality of output terminals.

Thus, it is possible to lower the output impedance of the reference-voltage output terminals so as to make it easy to set the data line voltage to a desirable voltage.

Further, according to the present invention, the reference voltage production circuit may include a second voltage division circuit that includes a ladder resistor with a plurality of resistive elements connected in series, and connects M voltage division terminals of the ladder resistor to the output terminals of the M impedance conversion circuits, and outputs reference voltages to reference voltage output terminals that are N ($N \geqq 2 \times M$) output voltage terminals of the ladder resistor.

Hence, it is possible to lower the output impedance of the N reference voltage output terminals by using impedance conversion function of the M impedance conversion circuits.

Further, according to the present invention, the second voltage division circuit may comprise a first ladder resistor having low resistivity relative to a second ladder resistor; a second ladder resistor having high resistivity relative to the first ladder resistor; a first switching portion that switches resistors connecting either of M voltage division terminals of the first ladder resistor having low resistivity, or M voltage division terminals of the second ladder resistor having high resistivity, to the output terminals of the M impedance conversion circuits; and a second switching portion that switches resistors connecting either of N the voltage division terminals of the first ladder resistor having low resistivity, or N voltage division terminals of the second ladder resistor having high resistivity, to the N reference voltage output terminals.

Thus, it is possible to lower the output impedance of the reference voltage terminals while decreasing current flowing constantly in the ladder resistor.

Further, according to the present invention, the first switching portion for switching resistors may connect M voltage division terminals of the first ladder resistor having low resistivity to M output terminals of the impedance conversion circuits during the overlapped period, and the second switching portion for switching resistors connects N voltage division terminals of the first ladder resistors having low resistivity to N output terminals of the impedance conversion circuits during the overlapped period.

Further, the first switching portion for switching resistors may connect M voltage division terminals of the second ladder resistor having high resistivity to M output terminals of the impedance conversion circuits and the second switching portion for switching resistors may connect N voltage division terminals of the second ladder resistors having high resistivity to N output terminals of the impedance conversion circuits during the latter part of overlapped period and/or a successive period after the overlapped period (the latter part of the drive period).

Further, according to the present invention, the switching signal production circuit may include a circuit that varies at least one of the timing of activating and/or deactivating the first switching signal for demultiplexing, the timing of activating and/or deactivating the second switching signal for demultiplexing, and the timing of activating and/or deactivating the third switching signal for demultiplexing to be variable.

Hence, it is possible to set the overlapped period easily during periods of activating the first, second, and third signals for demultiplexing.

Further, according to the present invention, a drive circuit for driving a display panel may include a plurality of pixels, a plurality of scanning lines and a plurality of data lines, comprising; a reference voltage production circuit that produces a plurality of reference voltages; a digital to analog conversion circuit that converts digital gray scale data into analog gray scale voltage using the plurality of reference voltages; and an output circuit that outputs analog gray scale voltage from the digital to analog conversion circuit to a data line, wherein; the reference voltage production circuit includes: a first voltage division circuit that includes a first ladder resistor with a plurality of resistance elements connected in series that output M (M is an integer greater than 2) voltages to M voltage division terminals of the first ladder resistor; M impedance conversion circuits that input each of the M voltages from the first voltage division circuit and output each voltage to produce reference voltages at each of a plurality of output terminals; and a second voltage division circuit including a second ladder resistor with a plurality of resistive elements connected in series, connecting M voltage division terminals of the second ladder resistor to the output terminals of the M impedance conversion circuits, and outputting reference voltages to reference voltage terminals that are N ($N \geqq 2 \times M$) voltage division terminals of the second ladder resistor.

Further, according to the present invention, a drive circuit for driving a display panel may include a plurality of pixels; a plurality of scanning lines; a plurality of multiplexed data lines each transmitting data signals for first, second, and third color components; and a plurality of first, second, and third switching elements for demultiplexing, one end of each of the plurality of first, second, and third switching elements being connected to each of the plurality of multiplexed data lines and the other end being connected to each of the plurality of pixels for the first, second, and third color components; and a switching signal production circuit that produces first, second and third switching signals for demultiplexing, and that controls turning on and off of the plurality of first, second, and third switching elements; and the switching signal production circuit includes a circuit that varies at least one of the timing of activating and/or deactivating the first switching signal for demultiplexing, the timing of activating and/or deactivating the second switching signal for demultiplexing, and the timing of activating and/or deactivating the third switching signal for demultiplexing.

Further the present invention relates to an electro-optical device including the above-mentioned drive circuit and a display panel driven by the drive circuit.

DESCRIPTION OF THE PREFERRED EMBODIMENTS

A present embodiment is described in detail hereafter referring to drawings.

The present embodiments explained hereafter do not limit the spirit of the present invention described in the scope of the claims. In addition, all of constituents explained in the present embodiments may not be required as indispensable elements of the present invention.

Figure 1:
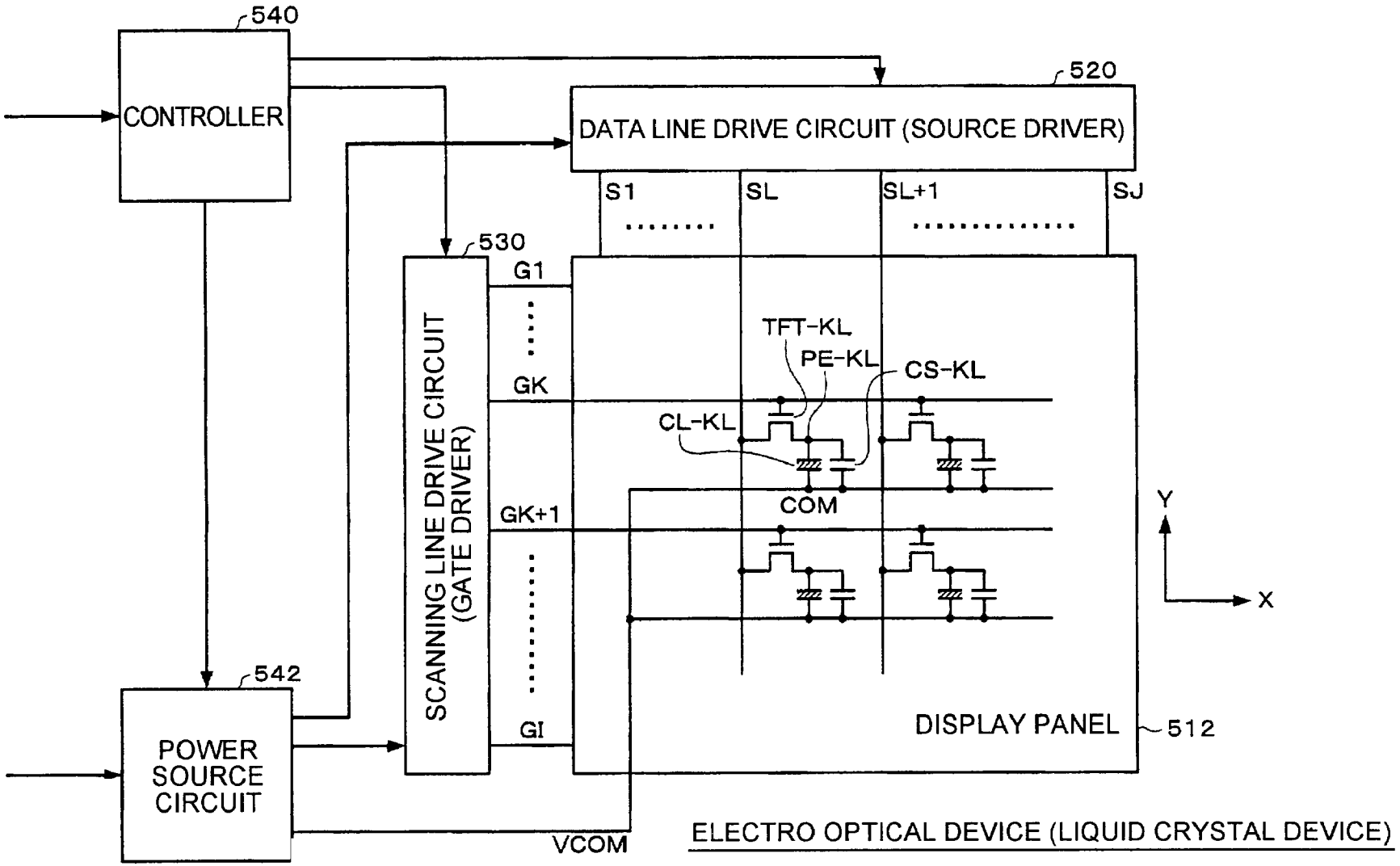
FIG. 1 is a block diagram of an example of an electro-optical device (a liquid crystal device).

FIG. 1 shows an example of an electro-optical device of the present embodiment (e.g. a liquid crystal device).

This electro-optical device includes a display panel 512, such as a Liquid Crystal Display (LCD) panel, a data line drive circuit 520 (e.g. a source driver), a scanning line drive circuit 530 (e.g. a gate driver), a controller 540, and a power supply circuit 542. It is not necessary to include all these circuit blocks in an electro-optical device, and some of them may be omitted in a particular device.

The display panel 512 (electro-optical panel) includes plural scanning lines (gate lines), plural data lines (source lines) and pixels specified by scanning lines and data lines. Thin film transistors TFT (more generally, switching elements for pixels) are connected to data lines and pixel electrodes so as to form an active matrix type electro-optical device.

The display panel 512 comprises an active matrix substrate (for example, a glass substrate). In this active matrix substrate, scanning lines G1 to GI (I is a natural number greater than 2) extending in the X direction are arranged in plural rows along the Y direction, and data lines S1 to SJ (J is a natural number greater than 2) extending in the Y direction are arranged in plural columns along the X direction. A pixel is arranged at the position of the intersection of the scanning line GK ($1 \leqq K \leqq I$, K being a natural number) with the data line SL ($1 \leqq L \leqq J$, L being a natural number). Each pixel includes the thin film transistor TFT-KL (more generally, a switching element for a pixel), and the pixel electrode PE-KL.

A gate electrode of the TFT-KL is connected to the scanning line GK, a source electrode of the TFT-KL is connected to the data line SL and a drain electrode of the TFT-KL is connected to the pixel electrode PE-KL. A liquid crystal capacitance CL-KL (capacitance of electro-optical material) and an auxiliary capacitance CS-KL are formed between the pixel electrode PE-KL and the opposite electrode COM (common electrode), which is located oppositely to the pixel electrode PE-KL to sandwich a liquid crystal element (more generally an electro-optical material). A liquid crystal material is enclosed within the space between the active matrix substrate provided with the TFT-KL and the pixel electrode PE-KL and so on, and the opposite electrode provided with the opposite electrode COM. The transmittance ratio of the liquid crystal element is changed in response to applied voltage between the pixel electrode PE-KL and the opposite electrode COM.

A voltage VCOM applied to the opposite electrode COM (the first, and second common voltage) is produced by a power supply circuit 542. The opposite electrode COM may be arranged in stripes corresponding to each of scanning lines instead of being formed on the entire surface of the substrate.

The data line drive circuit 520 drives data lines S1 to SJ of the display panel 512 based on image data. The scanning line drive circuit 530 drives scanning lines G1 to GI of the display panel 512 with sequential scanning.

The controller 540 controls the data line drive circuit 520, the scanning line drive circuit 530 and the power supply circuit 542 in response to programmed contents in a host processor such as central processing unit (CPU) not shown in the drawing.

The controller 540 supplies the vertical synchronizing signal and the horizontal synchronizing signal, which are produced during setting of the operational mode or internally set, to the data line drive circuit 520 and the scanning line drive circuit 530. Further, the controller controls the timing of changing the polarity of the voltage VCOM applied to the opposite electrode COM for the power supply circuit 542.

The power supply circuit 542 produces various kinds of voltages, which are necessary for driving the display panel 512 and the voltage VCOM for the opposite electrode COM based on a reference voltage supplied from outside.

In FIG. 1, the electro-optical device includes the controller 540. However, the controller 540 may be physically located outside of the electro-optical device. Also, alternatively, the electro-optical device may include the host processor with the controller 540.

Further, at least one of the scanning line drive circuit 530, the controller 540, and the power supply circuit 542 may be installed within the data line drive circuit 520. In addition, a part or all of the data line drive circuit 520, the scanning line drive circuit 530, the controller 540, and the power supply circuit 542 may be installed on the display panel 512.

2. Drift of the Data Line Voltage

A liquid crystal element has a property of deterioration due to the application of a DC voltage for the long term. Hence, a drive system that changes the polarity of voltage applied to a liquid crystal element every predetermined period is necessary. With such a drive system, the drive circuit changes polarity every frame, changes polarity every scanning line (gate line), changes polarity every data line (source line), and changes polarity every dot.

Here, a drive system that changes polarity every scanning line means that a polarity of voltage applied to a liquid crystal element is changed every scanning period (every one or plural periods). For example, a voltage of positive polarity is applied to a liquid crystal element during the K scanning interval (a period of selecting No. K scanning line), a voltage of negative polarity is applied to a liquid crystal element during the K+1 scanning interval and a voltage of positive polarity is applied to a liquid crystal element during the K+2 scanning interval. On the other hand, in the next frame, a voltage of negative polarity is applied to a liquid crystal element during the K scanning interval. A voltage of positive polarity is applied to a liquid crystal element during the K+1 scanning interval and a voltage of negative polarity is applied to a liquid crystal element during the K+2 scanning interval.

Further, in this drive system of changing polarity every scanning line, the polarity of the voltage VCOM applied to the opposite electrode COM (referred to as common voltage hereafter) is changed every scanning interval.

Figure 2:
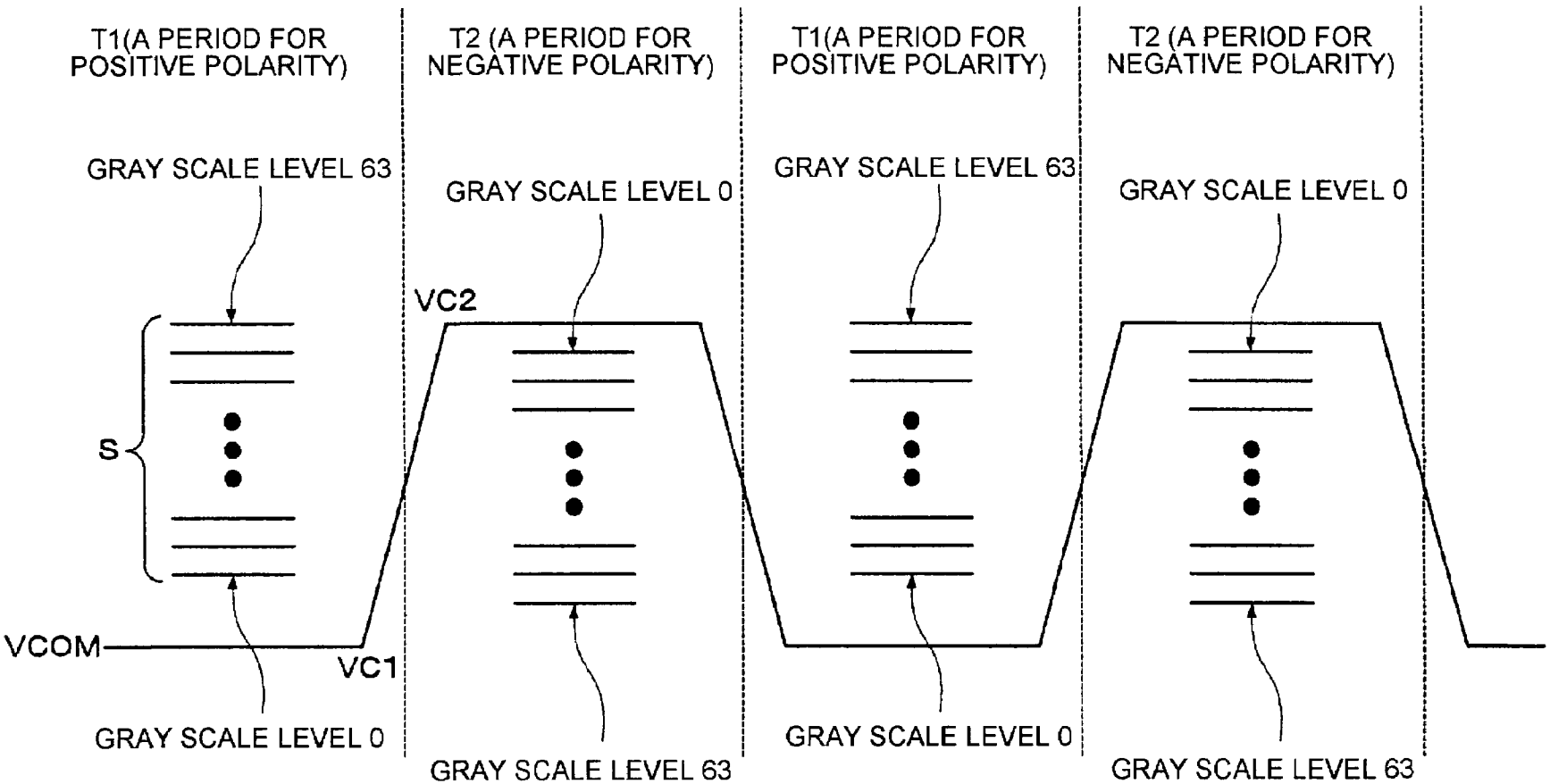
FIG. 2 is a diagram used to describe drive with changing polarity every scanning line.

In detail, as shown in FIG. 2, the common voltage VCOM becomes VC1 (the first common voltage) during the period T1 of positive polarity (the first period) and becomes VC2 (the second common voltage) during the period T2 of negative polarity (the second period).

Here, during the period T1 of positive polarity, a voltage applied to the data line S is higher than the common voltage VCOM. A voltage of positive polarity is applied to the liquid crystal element during the period T1.

On the other hand, during the period T2 of negative polarity, a voltage applied to the data line S is lower than the common voltage VCOM. During the period T2, voltage of negative polarity is applied to the liquid crystal element. In addition, VC2 is the voltage of which the polarity is changed from that of VC1 while a predetermined voltage is defined as the reference.

Changing the polarity of the common voltage VCOM can lower the voltage that is necessary for driving a display panel. Hence, the operating voltage of a drive circuit can be lowered such that manufacturing process of the drive circuit can be simplified and its cost can be reduced.

However, there is a problem where the data line voltage (the pixel electrode voltage) drifts due to the capacitive coupling effect of the liquid crystal capacitance CL, the auxiliary capacitance CS and the parasitic capacitance in the TFT when the polarity of the common voltage VCOM is changed.

Figure 3:
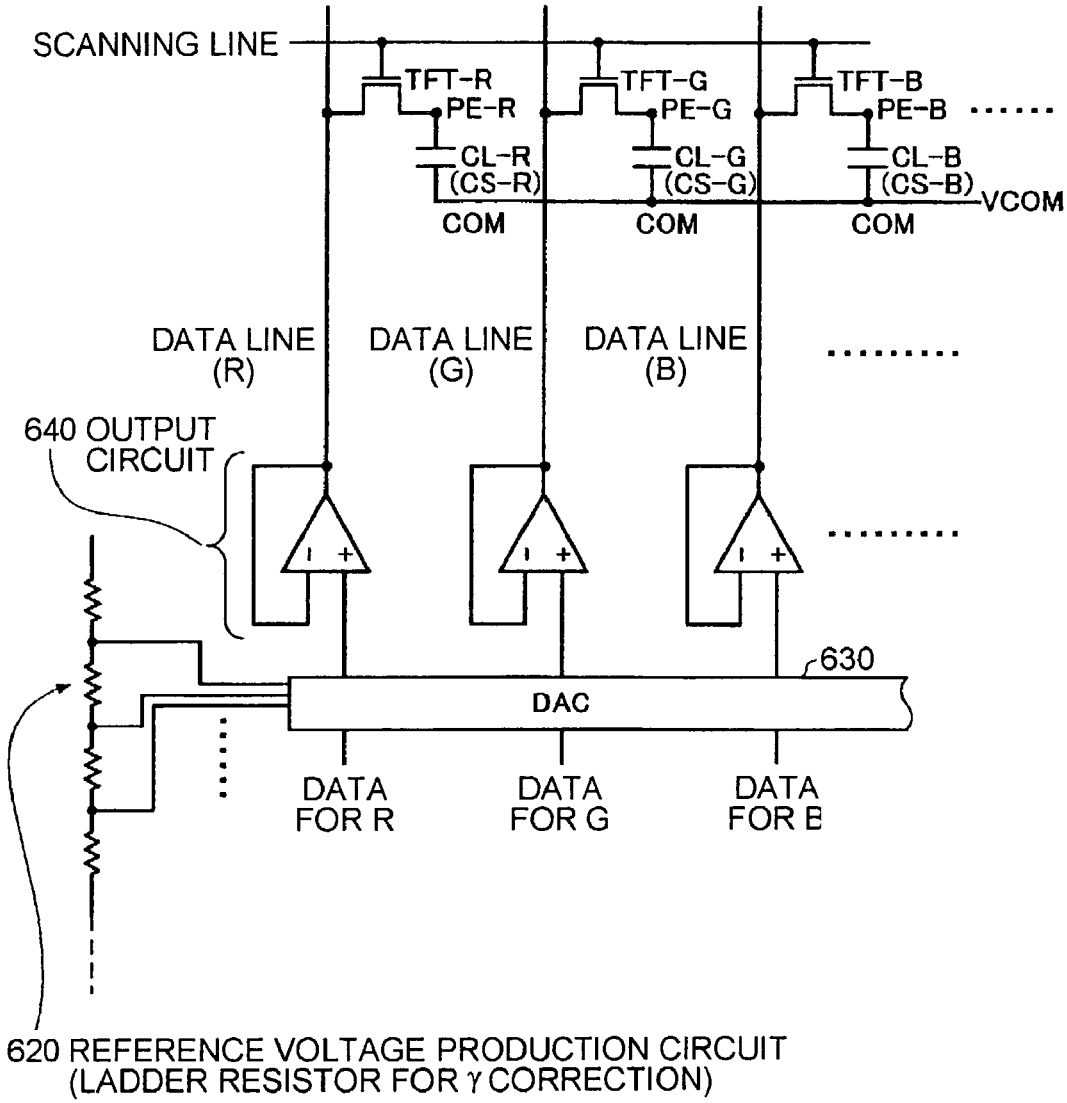
FIG. 3 is a diagram of a drive circuit including operational amplifiers.

In this case, the above-mentioned problem can be overcome in some degree if a drive circuit shown in FIG. 3 is adopted.

In FIG. 3, for example, a reference voltage production circuit 620 includes a ladder resistor for gamma correction and produces a plurality of reference voltages. A digital to analog circuit (DAC) 630 converts digital gray scale data (data for R, G, B) to analog gray scale voltages by using plural reference voltages from the reference voltage production circuit 620. An output circuit 640 outputs analog gray scale voltages from the DAC 630 to the data line.

In the drive circuit shown in FIG. 3, the output circuit 640 includes an operational amplifier of voltage follower junction type (an impedance conversion circuit, generally), which drives each data line. Therefore, even if the data line voltage drifts because of changing the polarity of the common voltage, this voltage drift can be suppressed to a minimum so as to set the data line voltage (the pixel element electrode voltage) for a desired gray scale voltage shown in FIG. 4A during a short period.

However, in the drive circuit of FIG. 3, all data lines are connected to operational amplifiers having great power consumption. Hence, there is a problem where total-power consumption becomes undesireably large.

Figure 5:
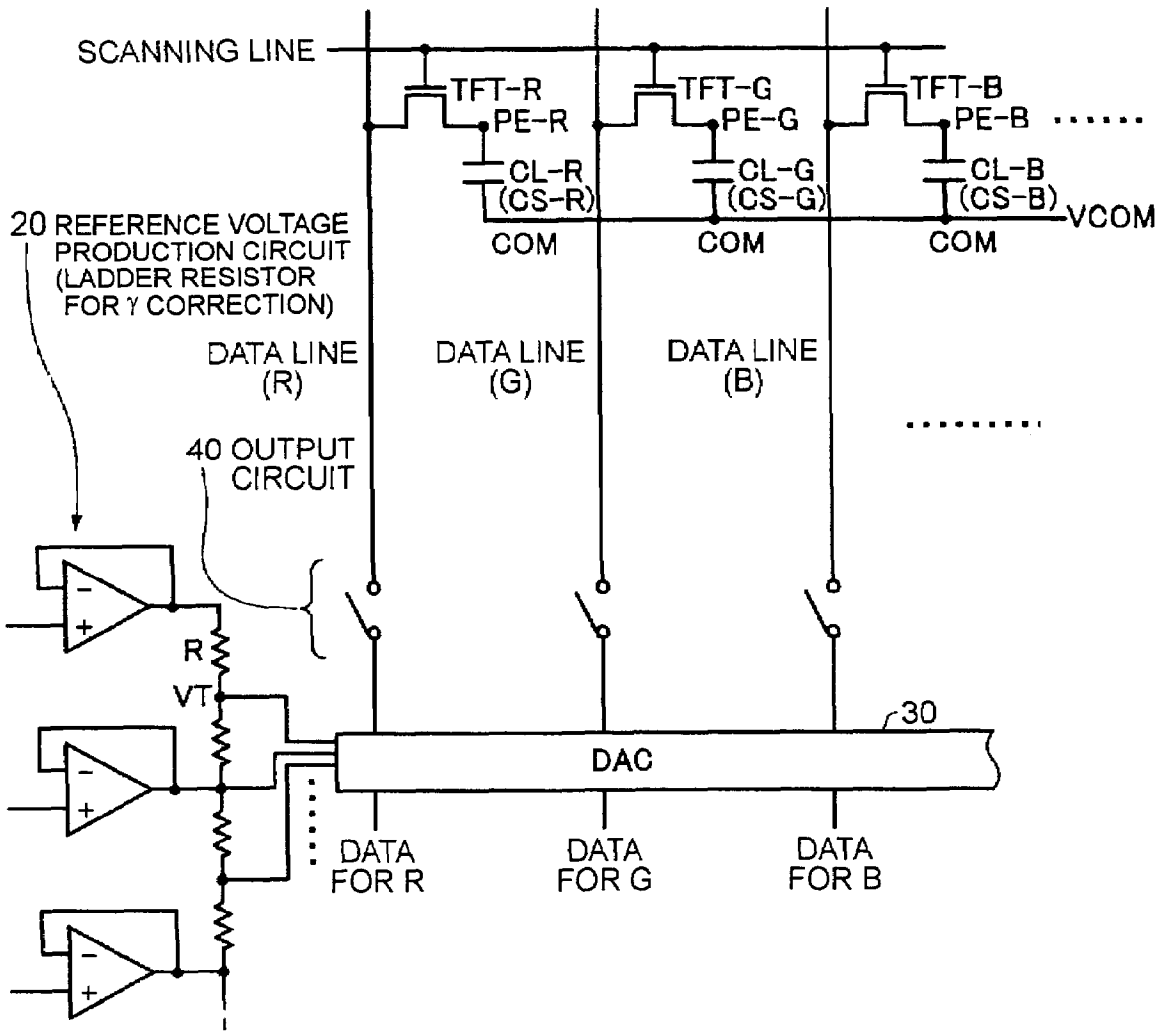
FIG. 5 is a diagram of a drive circuit without operational amplifiers.

Therefore, according to the present embodiment, a drive circuit shown in FIG. 5 is adopted.

Namely, in FIG. 5, the output circuit 40 does not include operational amplifiers, but includes switching elements between the output terminal and the data line for turning on-off instead. Further, the reference voltage production circuit 20 includes operational amplifiers of voltage follower junction (generally, impedance conversion circuits) instead of adopting operational amplifiers in the output circuit 40.

According to the structure in FIG. 5, the output circuit 40 does not include operational amplifiers. Therefore, in comparison with the structure in FIG. 3, the power consumption can be reduced in correspondence with the number of operational amplifiers eliminated. In particular, the effect of lowering power consumption is great when there are a large number of data lines.

Figure 4A:
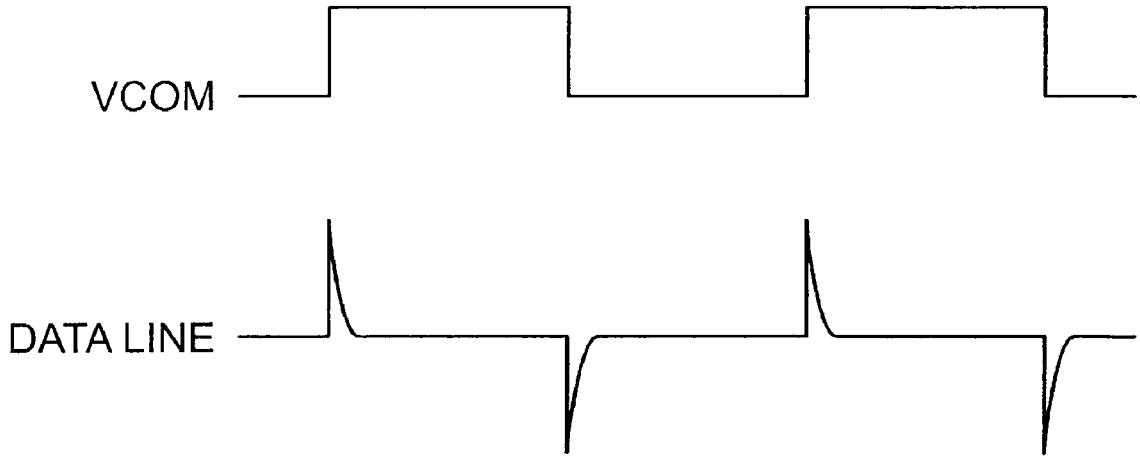
FIGS. 4A and B show drift of data line voltage.
Figure 4B:
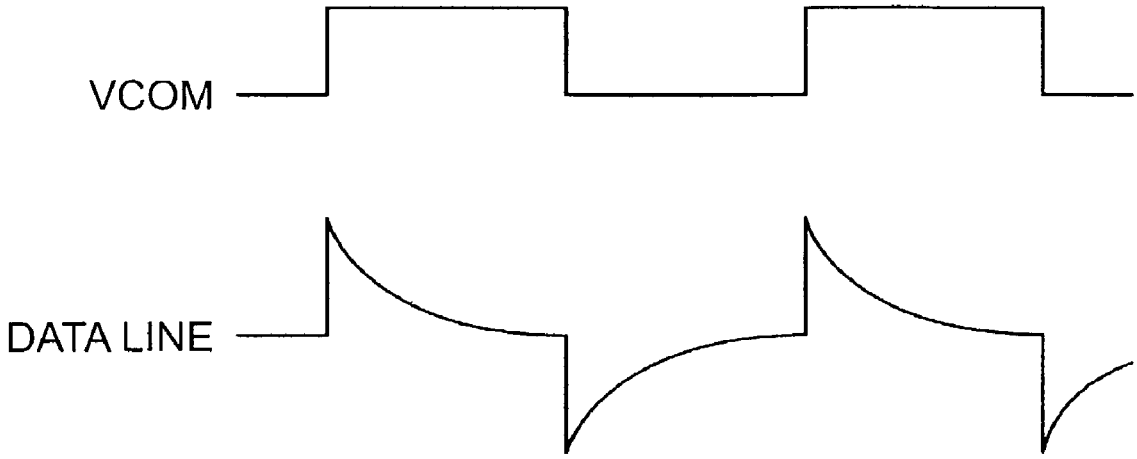

However, in the structure of FIG. 5, there is a problem in that it is difficult to set the data line voltage for a desired gray scale voltage during a short time due to the removal of the operational amplifiers in the output circuit 40, when the data line voltage (the pixel electrode voltage) drifts by changing the polarity of common voltage VCOM. Namely, as shown in FIG. 4B, there is a problem in that it takes too much time to return the data line voltage to appropriate voltage such that the data line voltage cannot be set to a desired voltage within the time required to assure a proper voltage of the pixel electrode PE.

In this case, such problem can be overcome to some degree by including operational amplifiers (impedance conversion circuits) in the reference voltage production circuit 20 as shown in FIG. 5.

However, even if operational amplifiers are included in the reference voltage production circuit 20 as shown in FIG. 5, it takes considerable time for the data line to reach a desired voltage when the polarity of the common voltage VCOM is changed when writing the reference voltage from the voltage division terminal VT as a gray scale voltage to all pixels. Namely, the time of reaching a desired voltage is delayed by the time constant determined with the resistance value of the ladder resistor (R) and the parasitic capacitance (CL, CS, data line capacitance and others). Further, if the resistance value of the ladder resistor is decreased in order to avoid such situation, there is a problem in which current constantly flowing in the ladder resistor is increased so as to increase the power consumption of the reference voltage production circuit 20.

Hence, according to the structure of FIG. 5, there is advantage of reducing the power consumption of the output circuit 40, while there is a problem in that it becomes difficult to control the drift of the data line voltage (the pixel electrode voltage) and the power consumption of the reference voltage production circuit 20 is increased.

3. Multiplexing of Data Signal

Figure 6A:
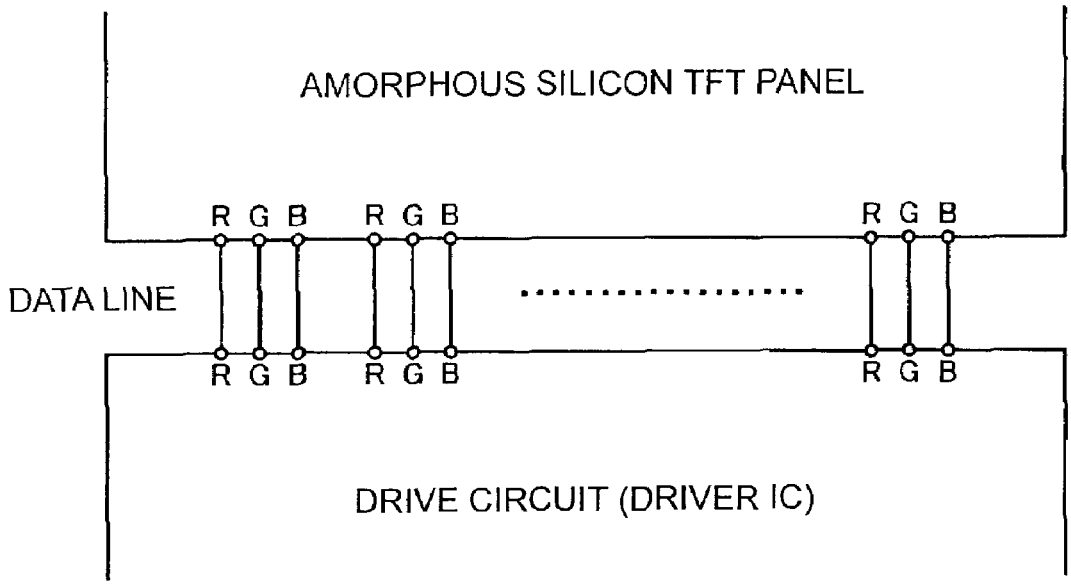
FIGS. 6A and B are used to describe a method of connecting data lines in an amorphous silicon TFT panel and a cold temperature poly silicon TFT panel.

In the display panel provided with TFT formed by amorphous silicon (generally referred to as a display panel of the first kind herein), each of data line output terminals corresponding to each of R, G, and B (generally, the first, second, and third color components) data lines (source lines) are installed in a driver IC (a drive circuit) as shown in FIG. 6A. In this case, the time assigned to each data line is comparatively long as shown in FIGS. 4A and 4B. Hence, even if the transient time of the data line voltage becomes long due to a resistor and parasitic capacitance, there is sufficient time provided by the timing provided to assure the pixel electrode voltage.

On the other hand, in a display panel provided with TFT that is formed of poly-silicon (polycrystalline silicon) at low temperature (generally referred to as a display panel of the second kind herein), a part of the circuits can be formed on the top of the panel. Hence, as shown in FIG. 6B, in order to reduce the numbers of wiring between a driver IC and a display panel, a system of using data lines for multiplexing data signals for R, G, and B and transmitting them so as to connect a driver IC with a display panel is provided.

Figure 6B:
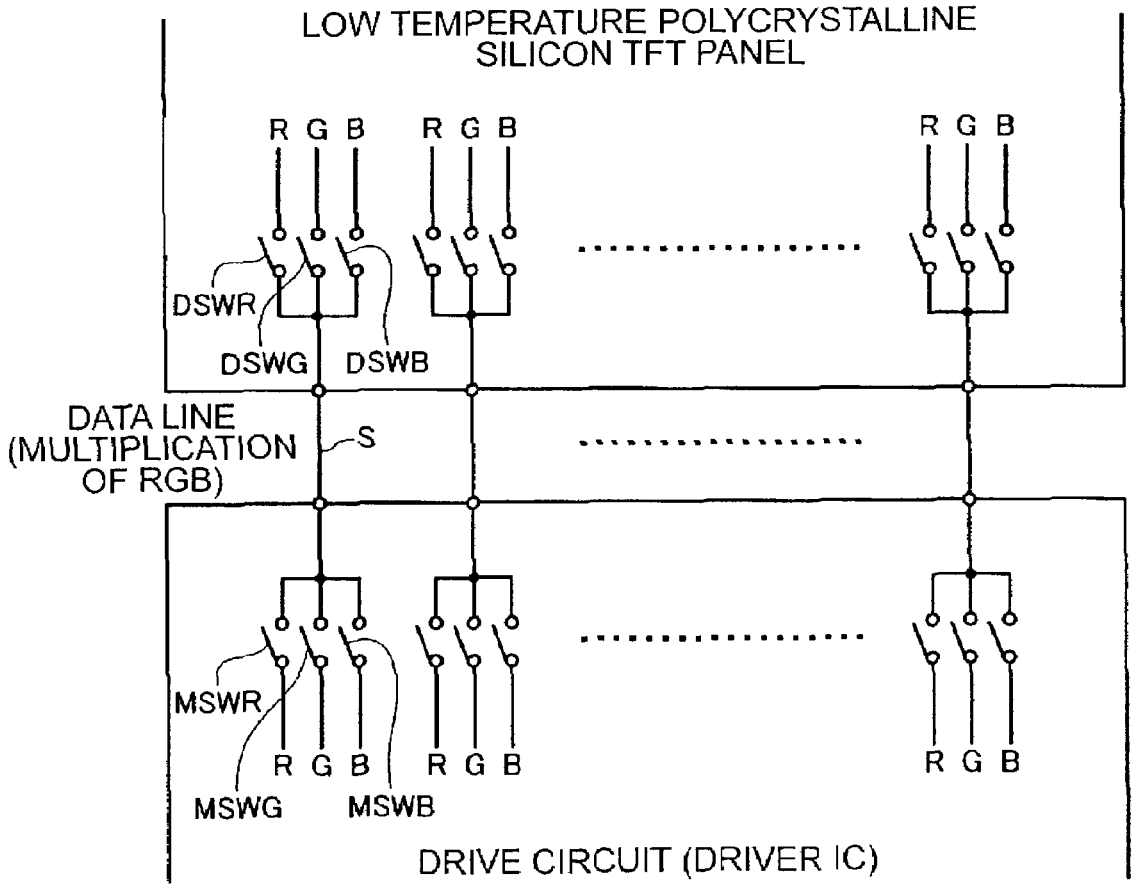

Namely, in this system of FIG. 6B, switching elements MSWR MSWG, and MSWB for multiplexing are installed in the driver IC side. Hence, data signals for R, G, and B are multiplexed by using these switching elements MSWR, MSWG, and MSWB, and transmitted to the display side via one data line.

Figure 7A:
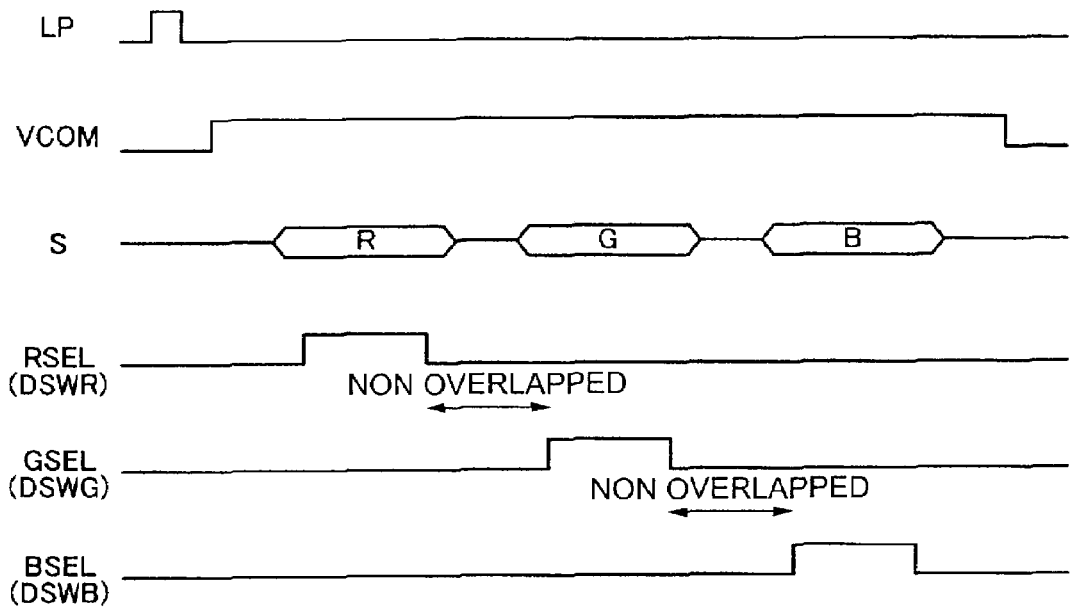
FIGS. 7A, B, and C are diagrams used to describe a method of multiplexing and transmitting data signals for R, G, and B and problems associated therewith.

On the other hand, switching elements DSWR, DSWG, and DSWB are installed for demultiplexing on the display panel side. Further, data signals for R, G, and B, multiplexed and transmitted by one data line S, are separated from each other by switching elements DSWR, DSWG, and DSWB for demultiplexing and supplied to each of pixels for R, G and B. In detail, these switching elements DSWR, DSWG, and DSWB are controlled for turning on-off by using switching signals RSEL, GSEL, BSEL as shown in FIG. 7A, so as to separate data signals for R, G, and B. In addition, in FIG. 7A, LP stands for a horizontal synchronization signal (latch pulse).

According to this system in FIG. 6B, there is an advantage in that the numbers of wiring between a display panel and a driver IC can be reduced such that the area of mounting wires can be small and a compact device can be realized.

Figure 7B:
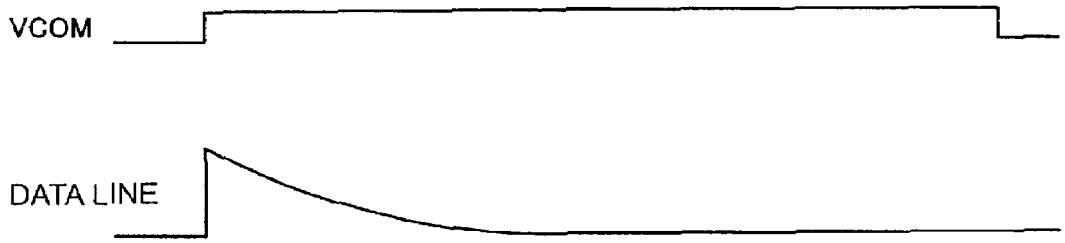
Figure 7C:
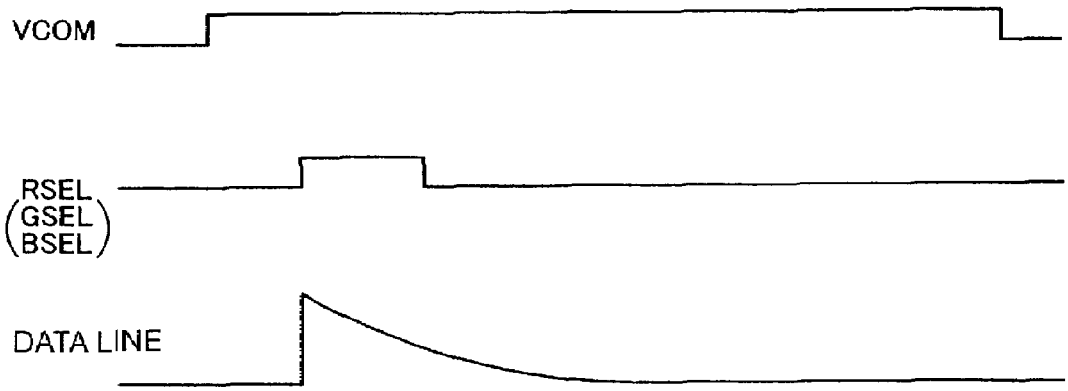

However, the time assigned to each of data signals of R, G, and B becomes under ⅓ of that for the amorphous silicon TFT panel of FIG. 6A (so-called ⅓ drive). Namely, in the amorphous silicon TFT panel of FIG. 6A, the time permitted for transient time of the data line voltage (the pixel electrode voltage) is long as shown in FIG. 7B. However, in the low temperature poly silicon TFT panel of FIG. 6B, the time permitted for transient time is too short as shown in FIG. 7C. Therefore, there is a problem of insufficient time to assuring the pixel electrode voltage such that it is difficult to drive the data line under the structure of the drive circuit shown in FIG. 5.

4. A Method of the Present Embodiment

Hence, in order to solve the above-mentioned problem, the following method is adopted in the present embodiment.

Figure 8A:
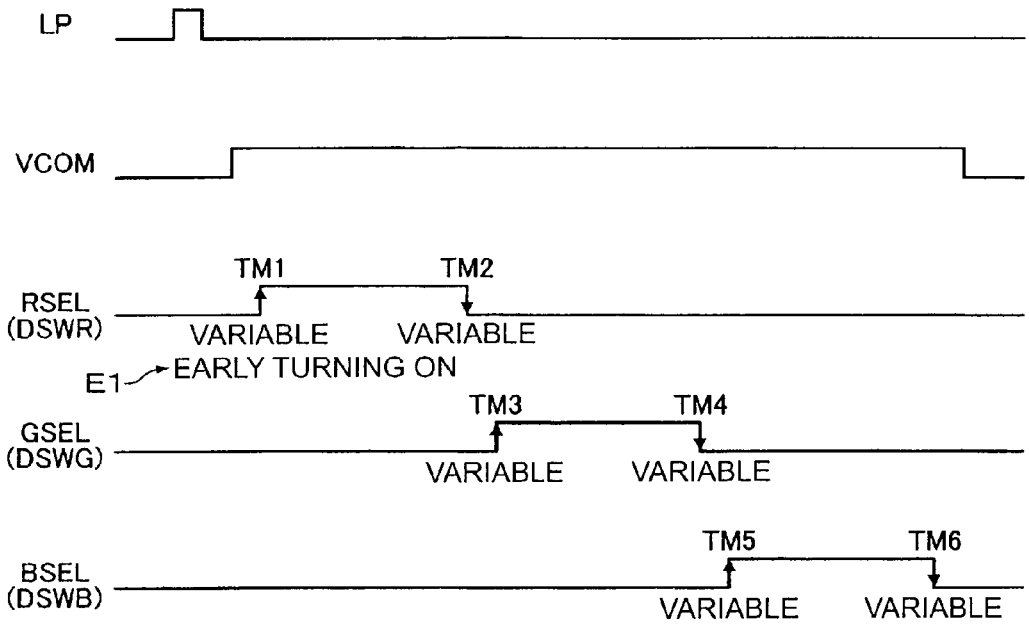
FIGS. 8A and B are diagrams used to describe a method of enabling the timing of activating switching signals for demultiplexing and the timing of deactivating them to be variable.

Namely, according to the present embodiment, as shown in FIG. 8A, switching signals RSEL, GSEL, and BSEL for demultiplexing, which control switching elements DSWR, DSWG, and DSWB to be turned on or off, are produced. Further these signals control timing TM1, TM3 and TM5 of activating RSEL, GSEL, and BSEL, and timing TM2, TM4, and TM6 of deactivating them to be variable.

Hence, the timing of TM1 to TM6 is controlled to be variable such that it is possible to activate early the switching signal RSEL as shown in E1 of FIG. 8A and turn on the switching element DSWR early. Thus, there is sufficient time to assure the pixel electrode voltage (before the time TM 2) such that it becomes easy to set the data line voltage (the pixel electrode voltage) for a desired gray scale voltage.

Figure 8B:
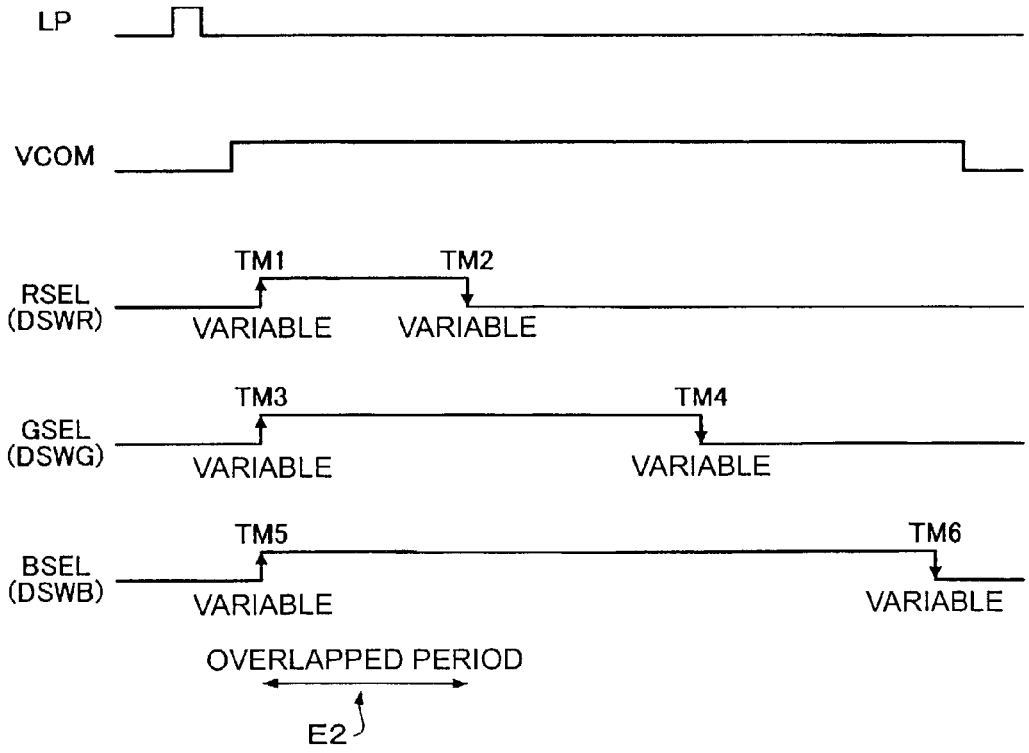

Further, the timing of TM1 to TM 6 is variably controlled such that it is possible to set the periods of activating switching signals RSEL, GSEL, BSEL (periods for turning DSWR, DSWG, DSWB on) to overlap, shown as E2 in FIG. 8B. Thus, all of switching elements DSWR, DSWG, and DSWB are turned on during this overlapped period such that programmed voltage can be applied not only to the pixel electrodes PER for R, but to the pixel electrodes PEG, PEB for G and B, respectively. Therefore, even if voltages applied to pixel electrodes PER, PEG, PEB drift due to changing the polarity of the common voltage VCOM, it is easy to set pixel electrode voltage for desired voltage within a short period.

Figure 9:
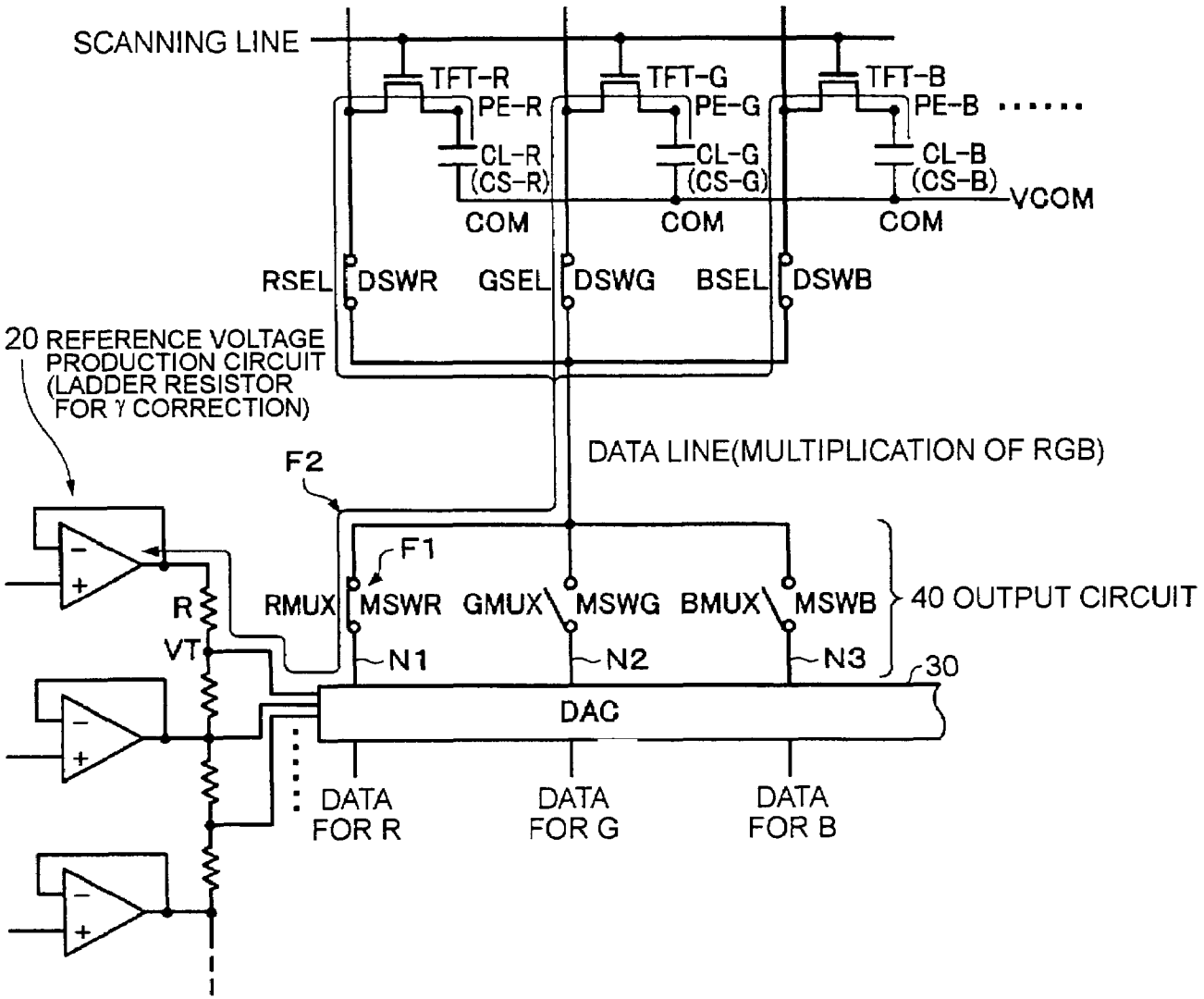
FIG. 9 is a diagram used to describe a method of applying a programmed voltage to a data line during the overlapped period of periods of activating a switching signal for demultiplexing.

In detail, according to the present embodiment, during the overlapped period, shown as E2 in FIG. 8B, of RSEL, GSEL, and BSEL, at least one of switching signals RMUX, GMUX, and BMUX (RMUX, for example) is activated, shown as F1 in FIG. 9. Then, at least one (for example, MSWR) of switching elements MSWR, MSWG, and MSWB for multiplexing is turned on.

Then, shown as F2 in FIG. 9, the programmed voltage (the reference voltage) is applied to pixel electrodes PER, PEG, and PEB by operational amplifiers included in the reference voltage production circuit 20. In other words, electric charges stored in the pixel electrodes PER, PEG, and PEB are taken out to the side of the reference voltage production circuit 20 via the path shown as F2 in FIG. 9. Thus, it is made easy to set pixel electrodes PER, PEG, PEB for the desired gray scale voltage.

In addition, in FIG. 9, the programmed voltage (the reference voltage) is applied to pixel electrodes PER, PEG, and PEB by using operational amplifiers included in the reference voltage production circuit 20 during the overlapped period. However, the voltage may be applied without using operational amplifiers. For example, divided voltages (reference voltages) from the ladder resistor, included in the reference voltage production circuit 20, may be applied to pixel electrodes PER, PEG, and PEB during the overlapped period without installing operational amplifiers in the reference voltage production circuit 20. Or, during the overlapped period, programmed voltage (for example, having the same phase of the common voltage) may be applied to nodes N1, N2 and N3 directly.

Here, according to the present embodiment, the signals RSEL, GSEL, and BSEL may be set such that periods of activating these signals are not overlapped by controlling the timings TM1 to TM 6 in FIG. 8A and B to be variable.

5. The Structure of a Drive Circuit

Figure 10:
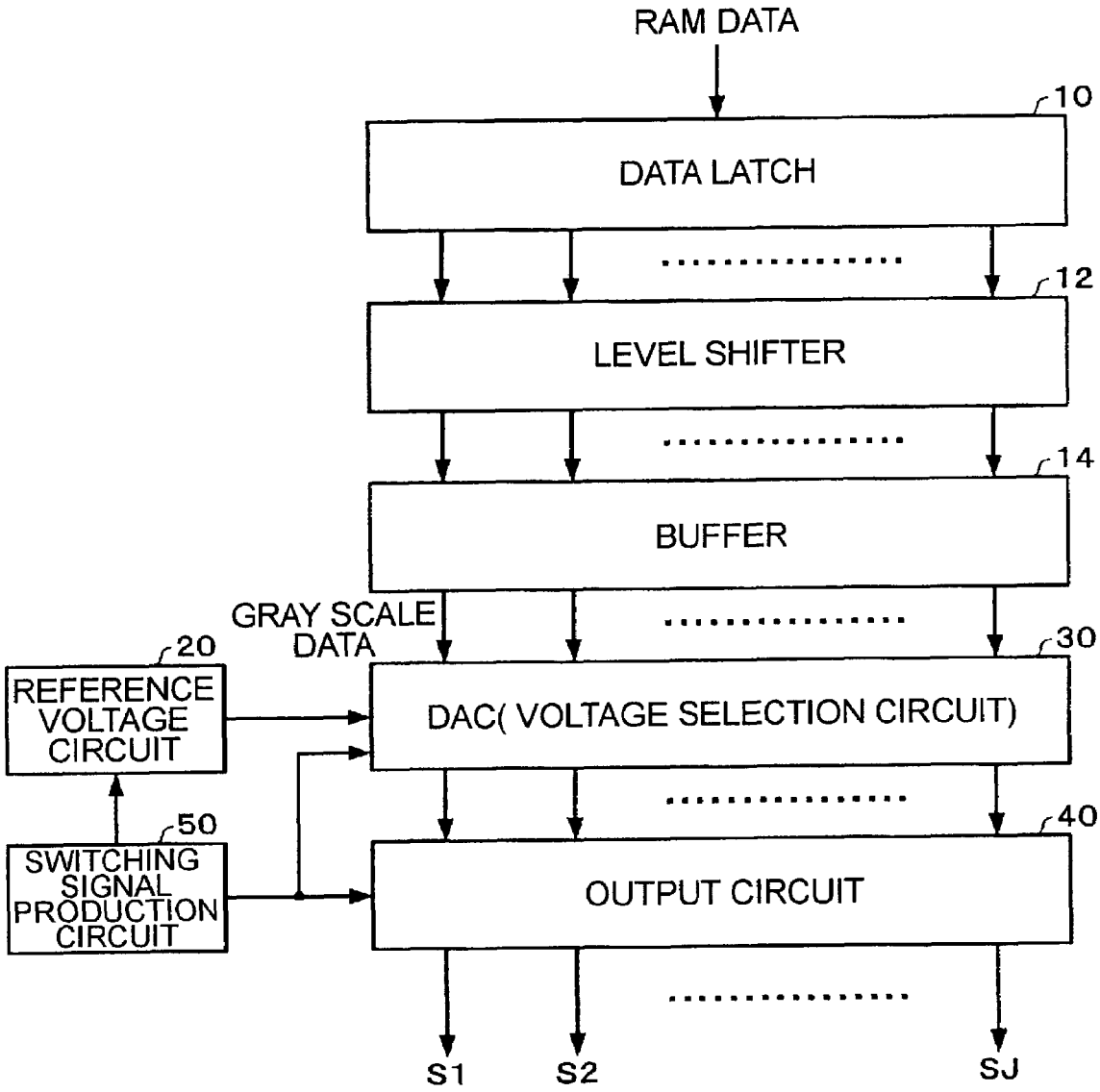
FIG. 10 is a diagram showing an example of a drive circuit.

FIG. 10 shows an example of a drive circuit (a data line drive circuit) of the present embodiment.

This drive circuit includes a data latch 10, a level shifter 12, and a buffer 14. In addition, it further includes the reference voltage production circuit 20, the DAC 30 (a digital to analog conversion circuit, a voltage selection circuit, and a voltage generation circuit), an output circuit 40, and a switching signal production circuit 50. All these circuits may not be necessary and a part of the circuit blocks shown may be omitted in a particular structure.

In FIG. 10, the data latch 10 latches data from RAM that is a display memory. The level shifter 12 shifts the level of voltage outputted from the data latch 10. The buffer 14 buffers data from level shifter 12, and outputs it to the DAC 30 as digital gray scale data.

The reference voltage production circuit 20 produces plural reference voltages to form a gray scale voltage. In detail, the reference voltage production circuit 20 includes a ladder resistor where plural resistance elements are connected in series. Then, the reference voltages are produced at the voltage division terminals (reference voltage production terminals) of the ladder resistor.

In this case, it is desirable to include an impedance conversion circuit as shown in FIG. 5 (e.g. an operational amplifier of voltage follower junction type) in the reference voltage production circuit 20. In detail, the reference voltage production circuit 20 includes the first and second voltage division circuits and inputs M (for example, 7) voltages from M ($M \geqq 2$) voltage division terminals of the ladder resistor, included in the first voltage division circuit, into M input terminals of the impedance conversion circuit. In addition, M voltage division terminals of the ladder resistor, included in the second voltage division circuit, are connected to M output terminals of the impedance conversion circuits, while N (for example, 64) reference voltages are outputted to the output terminals for reference voltages, which are $N(N \geqq 2 \times M)$ voltage division terminals of the ladder resistor.

The DAC 30 converts digital gray scale data from the buffer 14 to the analog gray scale voltage by using plural reference voltages from the reference voltage production circuit 20. In detail, digital gray scale data is decoded and any one of reference voltages is selected based on the decoded result and the selected reference voltage is outputted to the output circuit 40 as analog gray scale voltage. The decoder included in the DAC 30 can be realized by using ROM and so on.

The output circuit 40 is a circuit for transmitting an analog gray scale voltage from DAC 30 to the data line. This output circuit 40 can include switching elements, which control on-off for connecting the output terminals of the DAC 30 with the data lines S1 to SJ (switching elements for setting the data line for high impedance state at the time of changing polarity of common voltage). In addition, the output circuit 40 can include switching elements MSWR, MSWG, and MSWB shown in FIG. 6B and FIG. 9 (generally, the first, second and third switching elements for multiplexing).

The switching signal production circuit 50 produces switching signals for controlling the various kinds of switching elements, included in the output circuit 40, the reference voltage production circuit 20, and the DAC 30 to be turned on or off.

The switching signal production circuit 50 produces the switching signals RSEL, GSEL and BSEL (the first, second, and third switching signals for demultiplexing) for controlling the switching elements DSWR, DSWG, and DSWB (the first, second and third switching elements for demultiplexing) shown in FIG. 6B, and FIG. 9 to be turned on or off.

Further, as shown in FIG. 8B, the switching signal production circuit 50 produces RSEL, GSEL, and BSEL to create first, second, and third activation periods for the first, second, and third color components, respectively, such that the periods of activating RSEL, GSEL and BSEL (first, second, and third activation periods) overlap with each other.

This can be realized by including circuits the switching signal production circuit 50 (e.g. a register, a counter, a comparator and so on), that enable the timing of activating or deactivating RSEL, GSEL, and BSEL (i.e. times TM1 to TM 6 in FIG. 8B) to be variable.

In addition, it is desirable that the overlapped period for RSEL, GSEL and BSEL is set between the timing of changing the polarity of common voltage and the timing of assuring writing data signal to pixel electrodes (the timing of TM 2, TM 4, TM 6 in FIG. 8B).

In addition, it is desirable that the output circuit 40 outputs the programmed voltage during the overlapped period of RSEL, GSEL, and BSEL. This programmed voltage is a voltage for correcting any drift of the data line voltage caused by changing the polarity of common voltage to the normal state. This programmed voltage may be a reference voltage from reference voltage production circuit 20 as shown in FIG. 9 or a voltage of which the phase is the same phase of the common voltage (the voltage activated or deactivated by the same the timing of VCOM).

6. Output Circuit

Figure 11A:
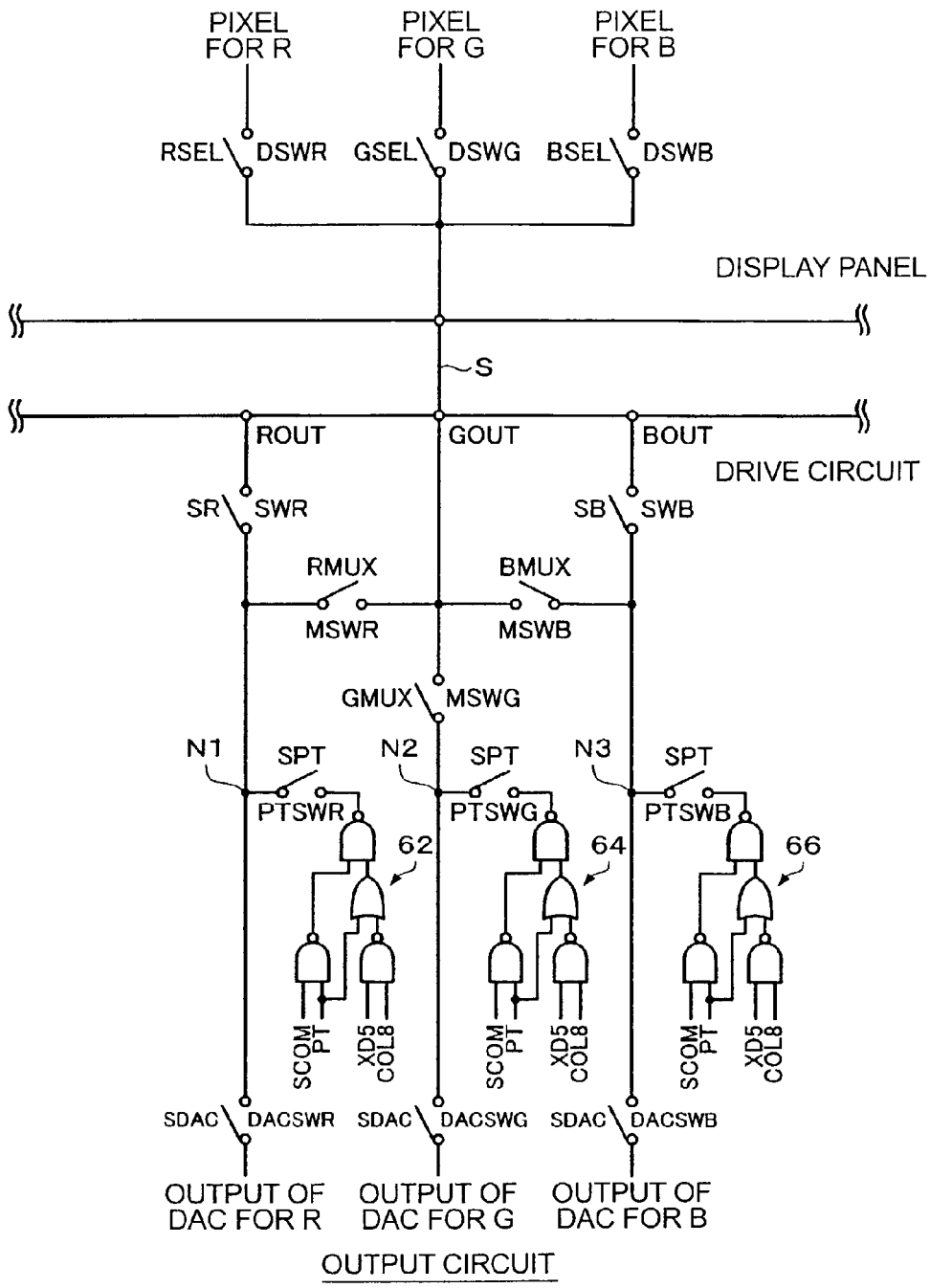
FIGS. 11A, B, and C are diagrams showing examples of output circuits and switching elements.

FIG. 11A shows an example of the output circuit 40. This output circuit 40 includes switching elements MSWR, MSWG, and MSWB for multiplexing. One end of each of these switching elements MSWR, MSWG, and MSWB, is connected to GOUT terminals (data line terminals for multiplexing) and the other end of each is connected to a respective node N1, N2, N3.

The switching signals RMUX, GMUX, and BMUX, produced by the switching signal production circuit 50, control turning these MSWR, MSWG, and MSWB switching elements on and off.

In addition, the output circuit 40 includes switching elements SWR and SWB for ROUT (for outputting the first color component) and BOUT (for outputting the third color component). One end of each of these switching elements SWR and SWB is connected to the ROUT terminal and the BOUT terminal, respectively; the other end of each is connected to the nodes N1 and N3, respectively. Further, the switching signals SR and SB, produced by the switching signal production circuit 50, control turning these SWR and SWB switching elements on and off. The switching element MSWG for multiplexing also serves as the switching element for GOUT (for outputting the second color component).

These switching elements SWR, MSWG, and SWB are employed when using the amorphous silicon TFT panel as shown in FIG. 6A. Namely, when using the amorphous silicon TFT panel, the multiplexing process for the data signal is not necessary so that the switching elements MSWR and MSWB for multiplexing are always off. Further, the switching elements SWR, MSWG, SWB are controlled to be turned on and off such that data signals (gray scale signals) for R, G, and B are supplied to the amorphous silicon TFT panel via ROUT, GOUT, and BOUT terminals (data lines for R, G and B).

The output circuit 40 includes the switching elements PTSWR, PTSWG, and PTSWB (the first, second and third voltage switching elements). One end of each of these switching elements PTSWR, PTSWG, and PTSWB is connected to the nodes N1, N2, N3, respectively and the other end of each is connected to the output terminals of the logic circuits 62, 64, and 66, respectively. The switching signal SPT, produced by the switching signal production circuit 50, controls turning these PTSWR, PTSWG and PTSWB switching elements on and off.

Signals SCOM, PT, XD5, and COL8 are input to the logic circuits 62, 64, and 66. The signal SCOM is a voltage phase of which is the same phase as the common voltage VCOM (the SCOM signal is activated and deactivated at the same timing as VCOM). The signal PT is activated at the time of a partial mode (a partial display). The signal XD5 is the most significant bit signal of digital gray scale data. The signal COL8 is activated for an eight-color mode.

In a partial mode, for example, the signal PT is activated (H level) and the voltage of signal SCOM is transmitted to the data lines (ROUT, GOUT, BOUT) via the switching elements PTSWR, PTSWG, and PTSWB from the logic circuits 62, 64, and 66. Hence, pixels connected to the data line enter a non-display state so as to realize the partial display (having a partial non-display area). Further, a programmed voltage (a voltage having the same phase as the common voltage) can be applied to the data line by using these switching elements PTSWR, PTSWG, and PTSWB during the overlapped period of RSEL, GSEL, and BSEL described below.

In addition, in the eight-color mode, the signal COL 8 is activated (H level) and the signal XD5 is transmitted to the data line via the switching elements PTSWR, PTSWG, and PTSWB from logic circuits 62, 64, and 66. Hence, display with eight colors can be realized.

The output circuit 40 includes switching elements DACSWR, DACSWG, and DACSWB. One end of each of these switching elements DACSWR, DACSWG, DACSWB is connected to the nodes N1, N2, N3, respectively, and other end of each is connected to the terminals for outputting analog gray scale voltage for R, G and B, respectivley of the DAC 30. The switching signal SDAC, produced by the switching signal production circuit 50 controls turning these DACSWR, DACSWG, and DACSWB on and off.

For example, when the switching elements PTSWR, PTSWG, and PTSWB are turned on, the switching elements DACSWG, DACSWG, and DACSWB are turned off so as to avoid conflicting outputs from these switching elements.

Figure 12:
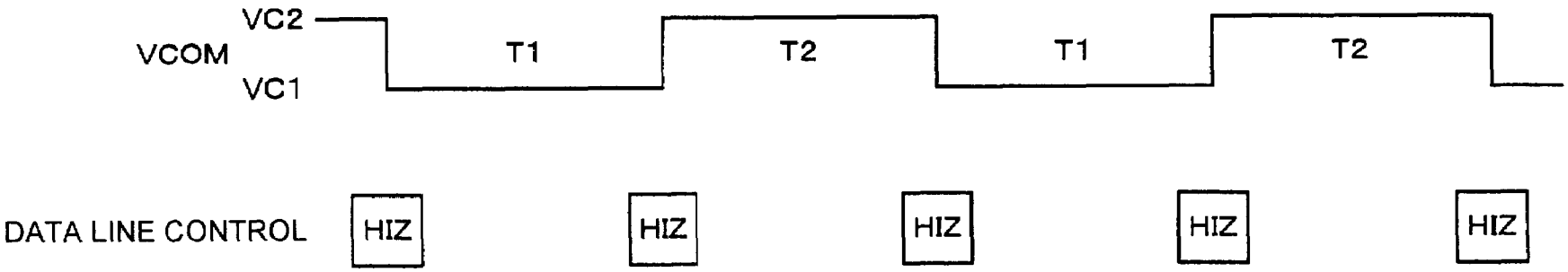
FIG. 12 is a diagram used in describing a method of setting data lines to be in high impedance state at the timing of changing polarity of common voltage.

In addition, DACSWR, DACSWG, and DACSWB (or, SWR, MSWG, and SWB) are turned off at the timing of changing polarity of common voltage so as to set the data line to a high impedance state during the predetermined period including the timing of changing polarity of common voltage as shown in FIG. 12. Hence, it is possible to return electric charges flowing at the output side of the drive circuit because of changing polarity of common voltage VCOM to the power source side so as to realize low power consumption.

Figure 11B:
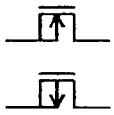
Figure 11C:
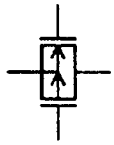

In addition, switching elements described in the present embodiment may be realized with an N type or a P type transistor as shown in FIG. 11B, or a transfer gate as shown in FIG. 11C (the gate constituted by connecting a drain region and a source region of a P type transistor and a N type transistor mutually).

7. The switching signal production circuit

In the present invention, the switching elements DSWR, DSWG and DSWB for demultiplexing are installed in the display panel as shown in FIG. 11A. One end of each of these switching elements DSWR, DSWG, and DSWB is connected to the data line S and the other end of each is connected to each of the pixels for R, G, and B, respectively (the first, second and third color components). Namely, these are connected to pixel electrodes for R, G and B (PER, PEG and PEB in FIG. 9) via TFT (switching elements for pixel).

The switching signals RSEL, GSEL, and BSEL for demutiplexing, produced by the switching signal production circuit 50, turn these DSWR, DSWG, and DSWB switching elements on and off.

Figure 13:
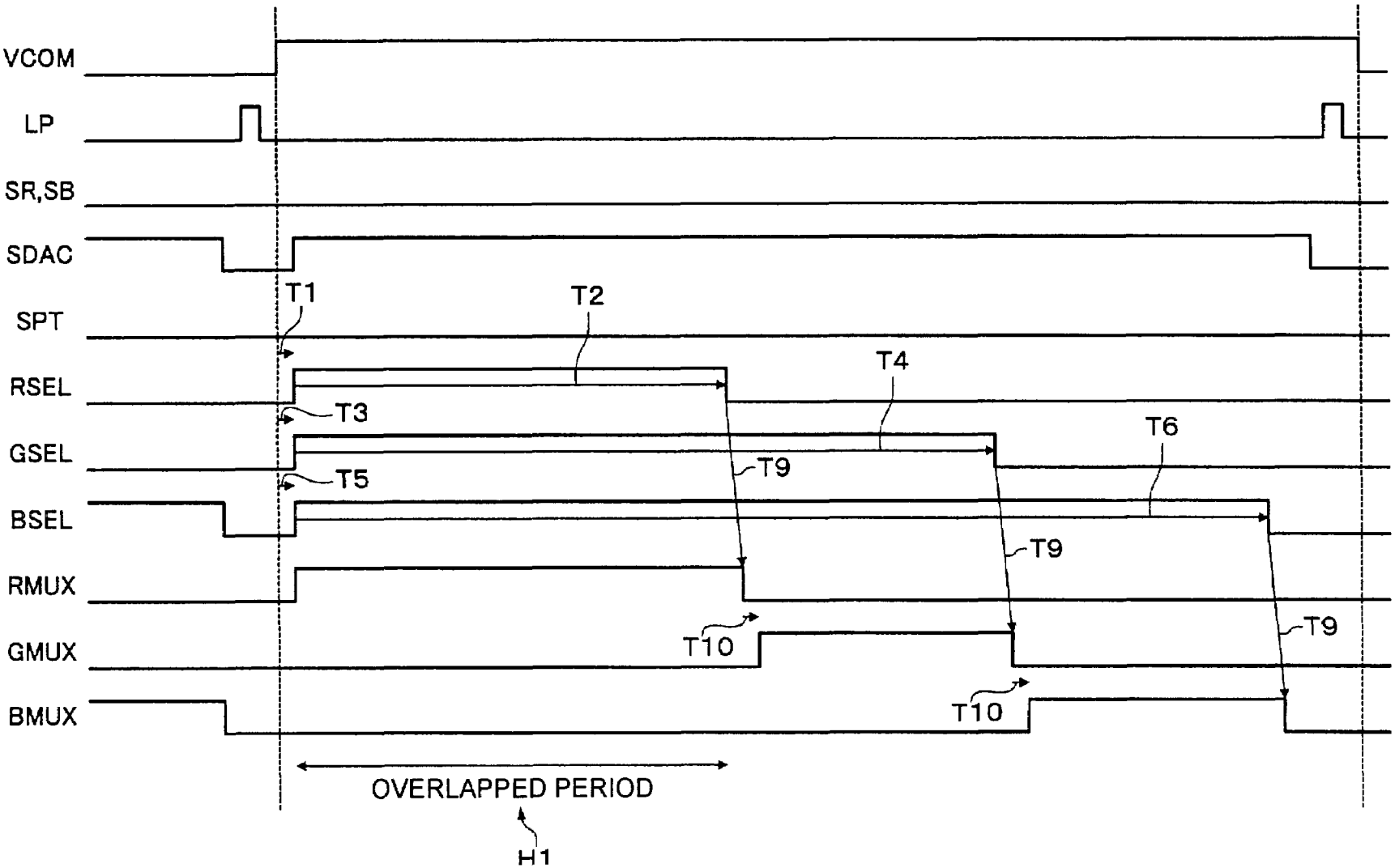
FIG. 13 is a diagram showing examples of timing waveforms of various signals such as a switching signal for demultiplexing.

FIG. 13 shows timing waveforms of various signals such as RSEL, GSEL, and BSEL.

In FIG. 13, the periods T1, T3 and T5 from the timing of changing polarity of VCOM (the timing of starting the horizontal scanning) to the timing of activating RSEL, GSEL, and BSEL and the periods T2, T4, and T6 from the timing of activating RSEL, GSEL, and BSEL to the timing of deactivating them can be varied. In addition, the period T9 from the timing of deactivating RSEL, GSEL, and BSEL to the timing of deactivating RMUX, GMUX, and BMUX and the period T10 from the timing of deactivating RMUX, GMUX to the timing of activating GMUX and BMUX can also be varied. In addition, RMUX is activated at the same the time as activation of RSEL.

Thus, these periods T1 to T6 can be varied so as to set the overlapped period of periods of activating RSEL, GSEL, and BSEL, shown as H1 in FIG. 13.

Figure 14:
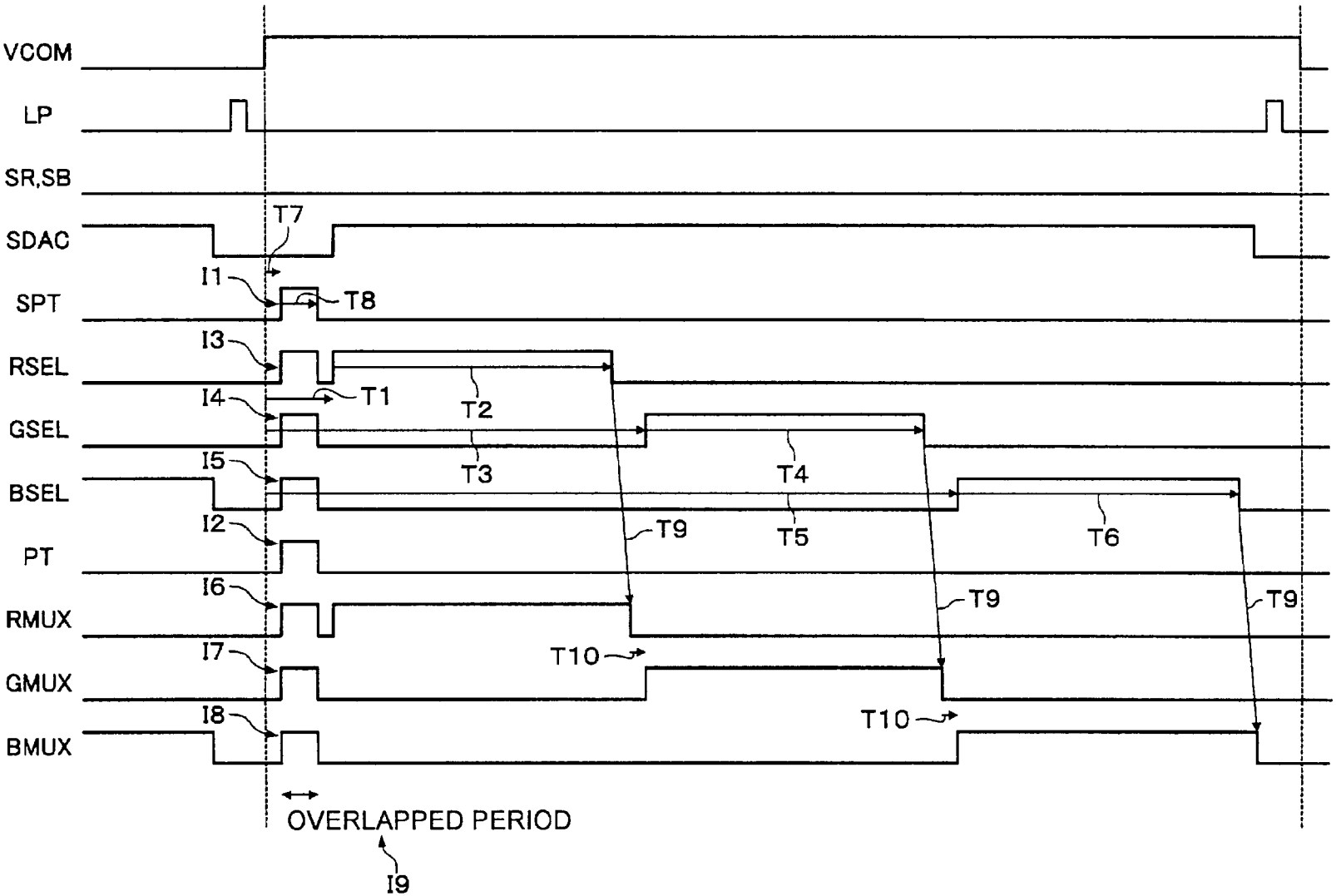
FIG. 14 is another diagram showing examples of timing waveforms of various signals such as switching signal for demultiplexing.

FIG. 14 shows another examples of timing waveform of signals.

In FIG. 14, in addition to T1 to T6, T9 and T10 shown in FIG. 13, the period T7 from the timing of changing polarity of VCOM to the timing of activating the switching signal SPT and the period T8 from the timing of activating SPT to the timing of deactivating it can be varied.

Hence, shown as I1 in FIG. 14, when the switching signal SPT is activated, switching elements PTSWR, PTSWG and PTSWB for applying voltage shown in FIG. 11A are turned on. In the period when the switching signal SPT is activated, the partial mode signal PT is also activated, shown as 12 in FIG. 14. The voltage of signal SCOM (the same phase as VCOM) is applied to the nodes N1, N2 and N3. Thus, in this period, the switching signals RSEL, GSEL, BSEL, RMUX, GMUX and BMUX are also activated, as shown as 13 to 18 in FIG. 14 and the switching elements DSWR, DSWG, DSWB, MSWR, MSWG, and MSWB in FIG. 11A are turned on thereby.

As a result, the voltage of SCOM (the same phase as VCOM) is applied to all pixel electrodes for R, G, and B and the pixel electrode voltage that may drift due to the changing polarity of VCOM can be set to the voltage of SCOM.

Figure 19:
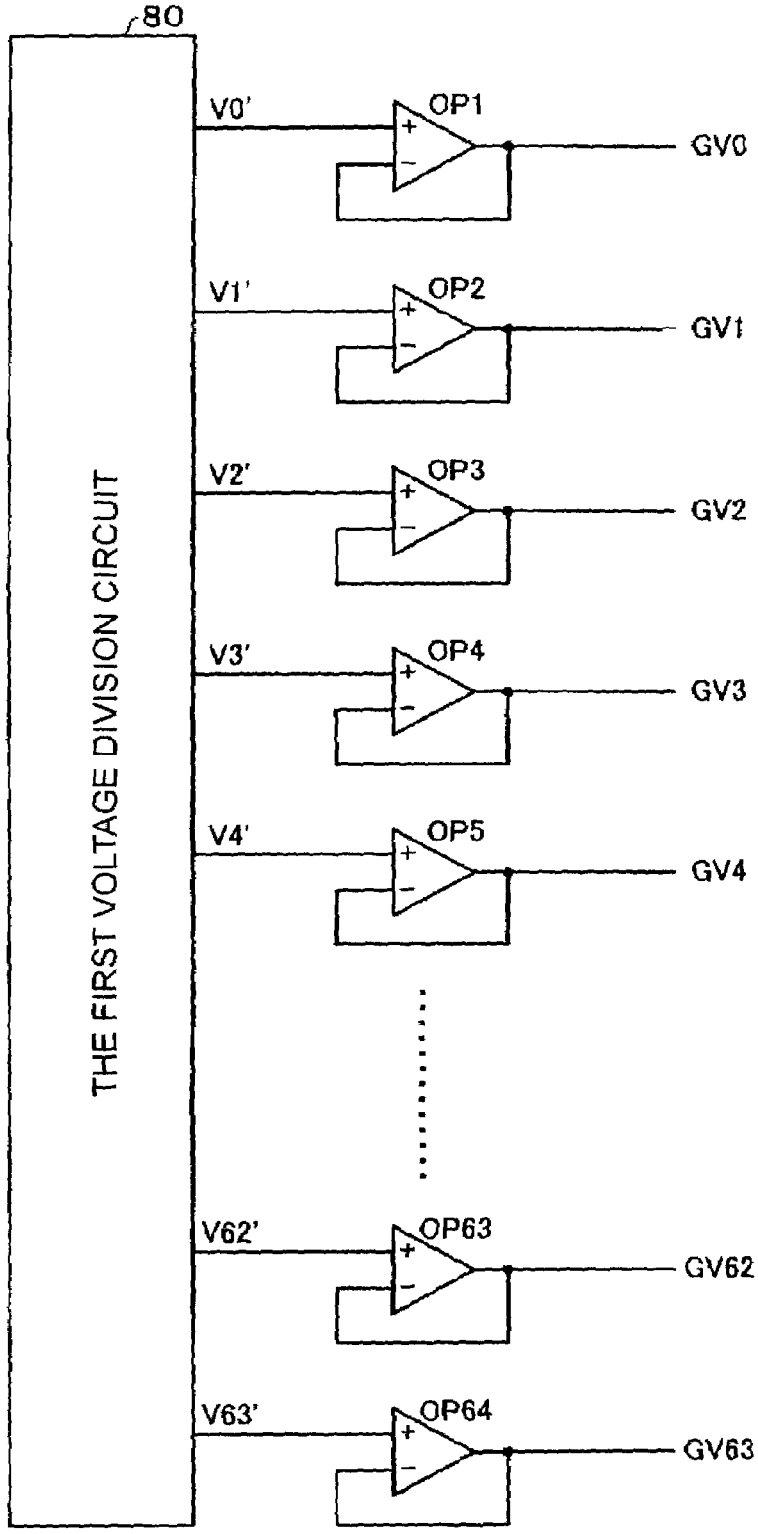
FIG. 19 is a diagram showing another example of a reference voltage production circuit.

In addition, in the present embodiment, shown as H1 in FIGS. 13 and 19 in FIG. 14, the overlapped period of the periods of activating RSEL, GSEL, and BSEL is set between the timing of changing polarity of common voltage VCOM and the timing of assuring writing data signal to the pixel electrodes (the timing of deactivating RSEL, GSEL and BSEL).

Figure 15:
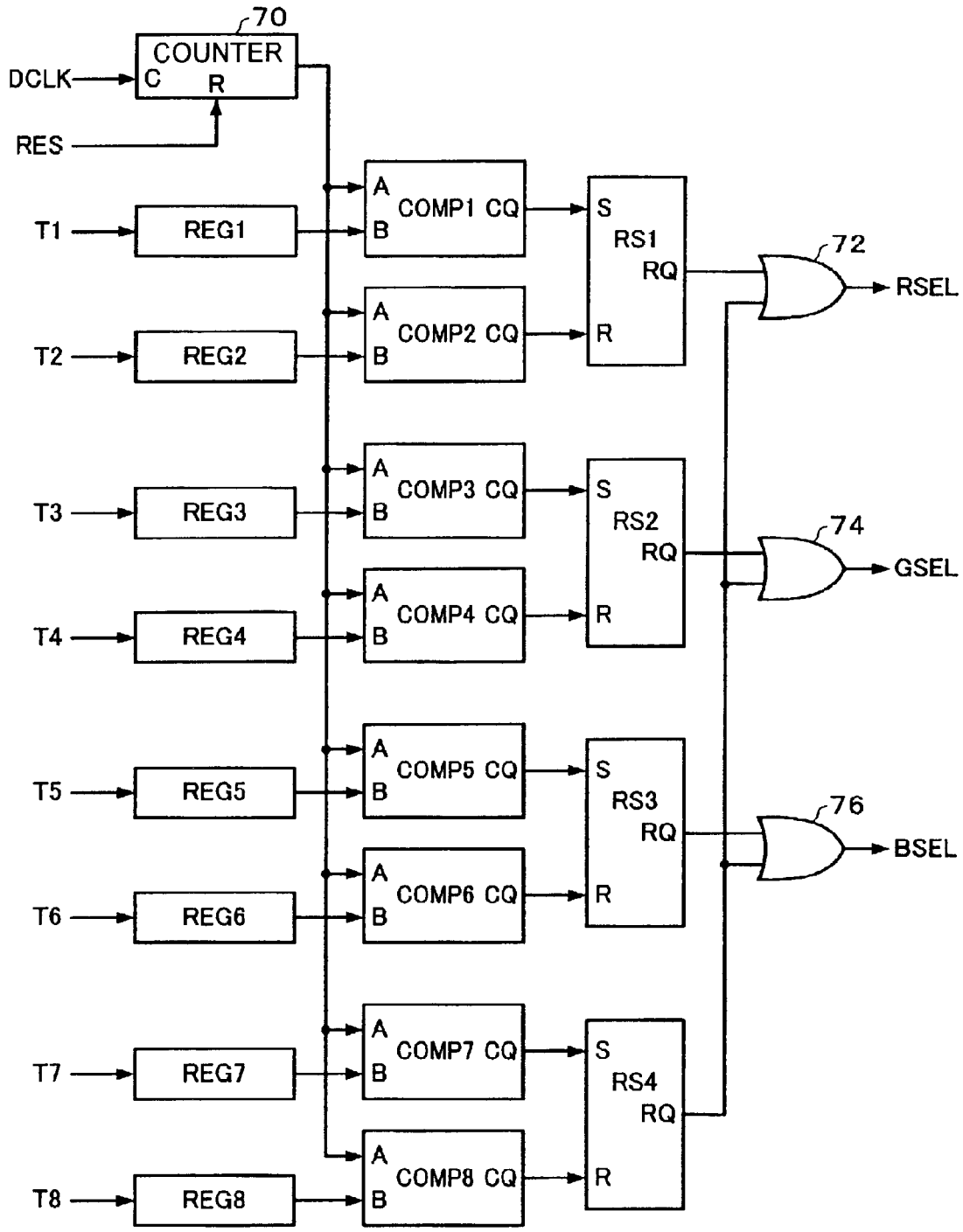
FIG. 15 is a diagram showing an example of a switching signal production circuit.

FIG. 15 shows an example of the switching signal production circuit 50 producing switching signals RSEL, GSEL, BSEL shown in FIG. 13 and FIG. 14.

A signal DCLK (dot clock) is input into the clock terminal of the counter 70 and a signal RES is input to the counter 70 reset terminal. DCLK is a clock signal for counting periods, and RES is a pulse signal that is activated at the timing of changing polarity of VCOM.

Registers REG1 to REG 8 are registers for setting periods T1 to T8 in FIG. 13 and FIG. 14. These setting periods T1 to T8 for registers REG1 to REG 8 are established by the controller 540 shown in FIG. 1 and an external CPU (processing portion).

The output from the counter 70 (the counted value) is input to the first input terminal A of comparators COMP1 to COMP8, the outputs (T1 to T8) from the register REG1 to REG8 are input to the second input terminal B so as to compare these input values. When the output (the counted value) from the counter 70 coincides with the outputs (T1 to T8) from the registers REG1 to REG8, the outputs CQ of comparators COMP1 to COMP8 are activated.

The outputs CQ from comparators COMP1, COMP3, COMP5, and COMP7 are input into the set terminals S of RS flip flop circuits RS1 to RS4 and the outputs CQ of comparators COMP2, COMP4, COMP6, and COMP8 are input into the reset terminals R of the flip flop circuits. The outputs RQ of RS flip flop circuits RS1 to RS4 are activated (H level) when the inputs at the set terminals S are activated, and they are deactivated (L level) when the inputs at the reset terminals R are activated.

The outputs RQ from flip flop circuits RS1, RS2 and R3 are input to the first input terminals of OR (logical sum) circuits 72, 74, and 76, and the output of the RS flip flop circuit RS4 is input into the second input terminals of them so as to output the switching signals RSEL, GSEL, and BSEL.

The timing of activating RSEL, GSEL and BSEL (the first, second, and third switching signal for demultiplexing) and the timing of deactivating them are thus variable using the circuits shown in FIG. 15 in the switching signal production circuit 50.

Figure 16:
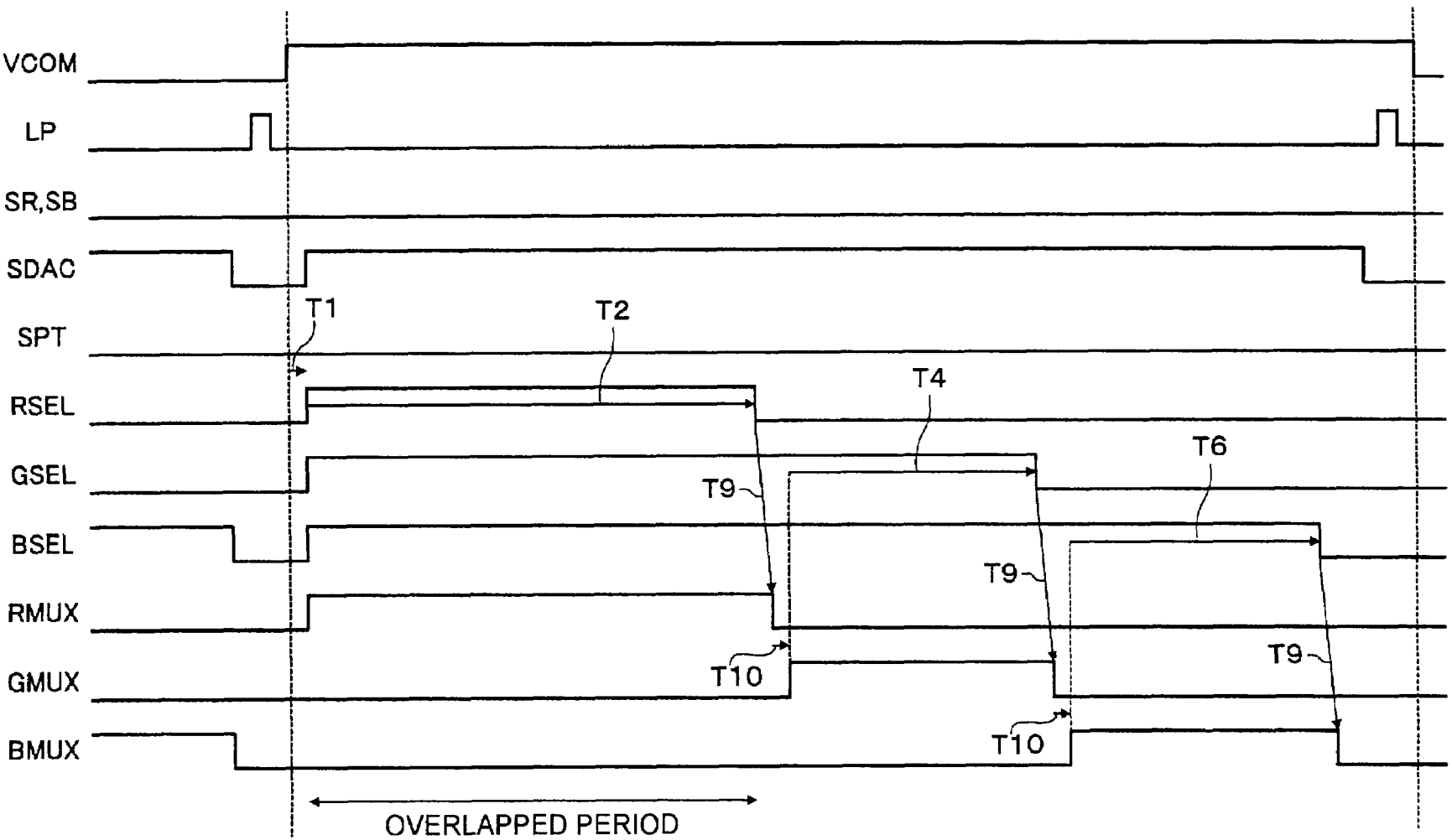
FIG. 16 is another diagram showing examples of timing waveforms of various signals such as a switching signal for demultiplexing.
Figure 17:
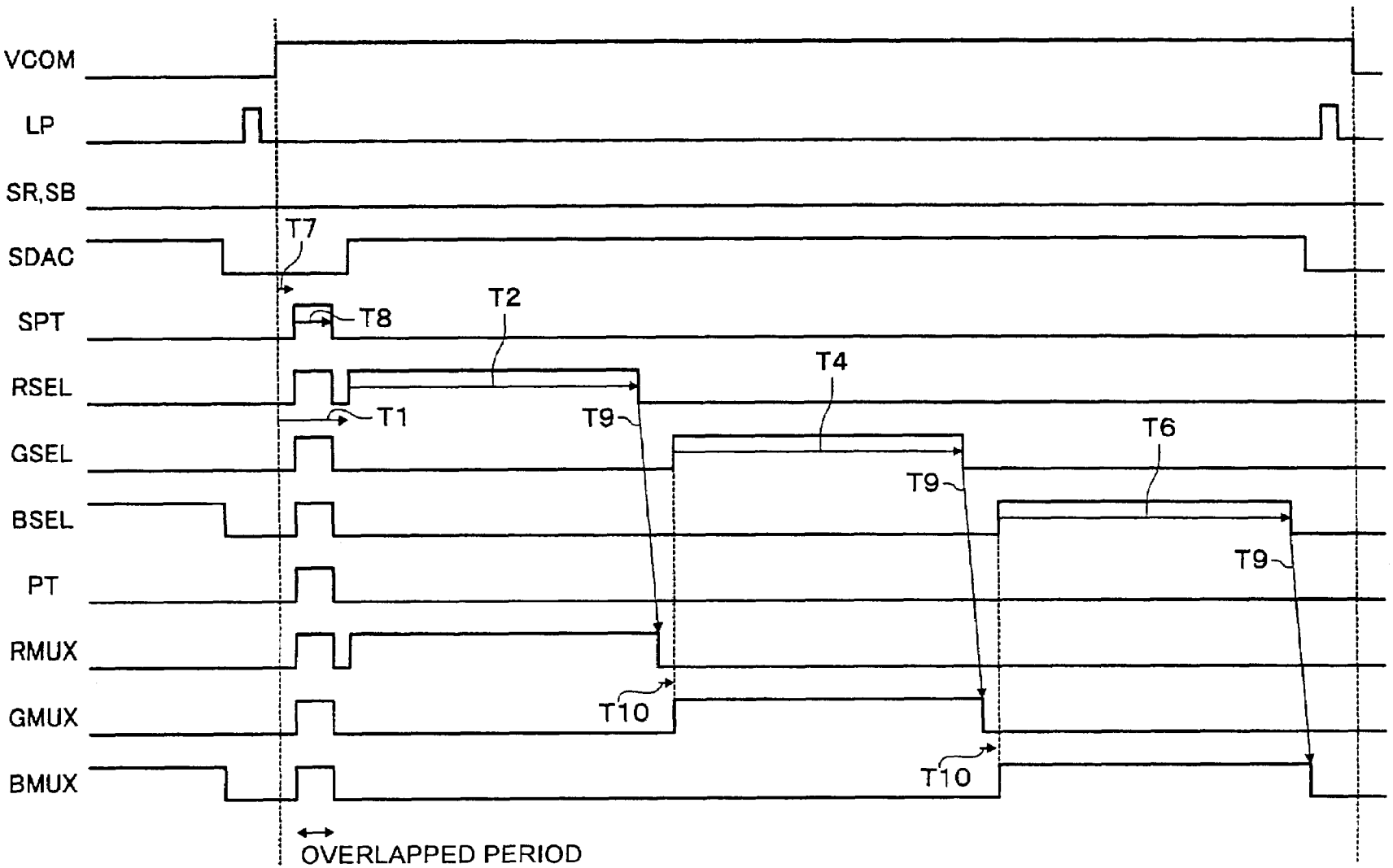
FIG. 17 is another diagram showing examples of timing waveforms of various signals such as a switching signal for demultiplexing.

FIG. 16, and FIG. 17 show examples of timing waveforms of signals.

In FIG. 16 and FIG. 17, the timing of deactivating GSEL and BSEL is set with the periods T4 and T6 from the timing of activating GMUX and BMUX to the timing of deactivating GSEL and BSEL. In addition, in FIG. 16, RSEL, GSEL, and BSEL are activated at the same timing. Thus, periods T3 and T5 that were necessary in FIG. 13, are not necessary and registers REG3 and REG5 in FIG. 15 can be omitted.

8. The Reference Voltage Production Circuit

Figure 18:
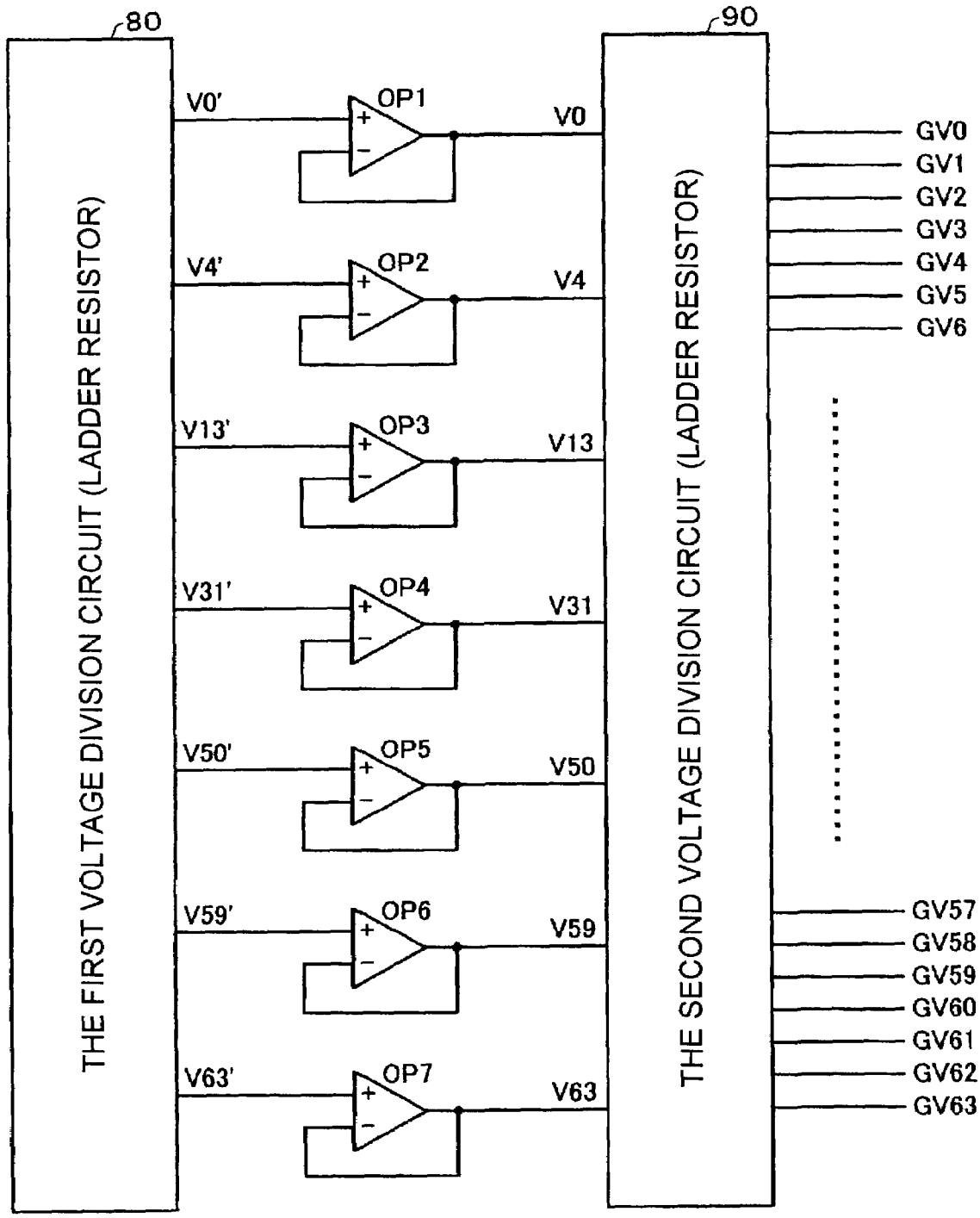
FIG. 18 is a diagram showing an example of a reference voltage production circuit.

FIG. 18 shows an example of the reference voltage production circuit 20.

This reference voltage production circuit 20 includes the first voltage division circuit 80 outputting voltages V0', V4', V13', V31', V50', V59' and V63' from (M voltages) from 7 voltage division terminals (M voltage division terminals).

In addition, the reference voltage production circuit 20 includes operational amplifiers of voltage follower junction type OP1, OP2, OP3, OP4, OP5, OP6, and OP7 (M impedance conversion circuits) that receive, on their input terminals, input voltages V0', V4', V13', V31', V50', V59', and V63' from the first voltage division circuit. These operational amplifiers OP1 to OP7 output voltages V0, V4, V13, V31, V50, V59 and V63 to the output terminals to produce reference voltages GV0 to GV63.

In addition, the reference voltage production circuit 20 includes a second voltage division circuit 90, with 7 voltage division terminals (M voltage division terminals) connected to the output terminals of operational amplifiers OP 1 to OP 7, and which outputs reference voltages to 64 reference voltage output terminals (N reference voltage terminals).

In addition, as shown in FIG. 19, a second reference voltage circuit 20 (different example) may include only the first voltage division circuit 80 without the second voltage division circuit 90.

Namely, in FIG. 19, the first voltage division circuit 80 outputs voltage V0' to V63' to the voltage division terminals. Hence, these voltages V0' to V63' are input into the input terminals of operational amplifiers OP1 to OP64 (impedance conversion circuits). Then, operational amplifiers OP1 to OP64 output reference voltages GV0 to GV63 to the reference voltage output terminals.

Figure 20:
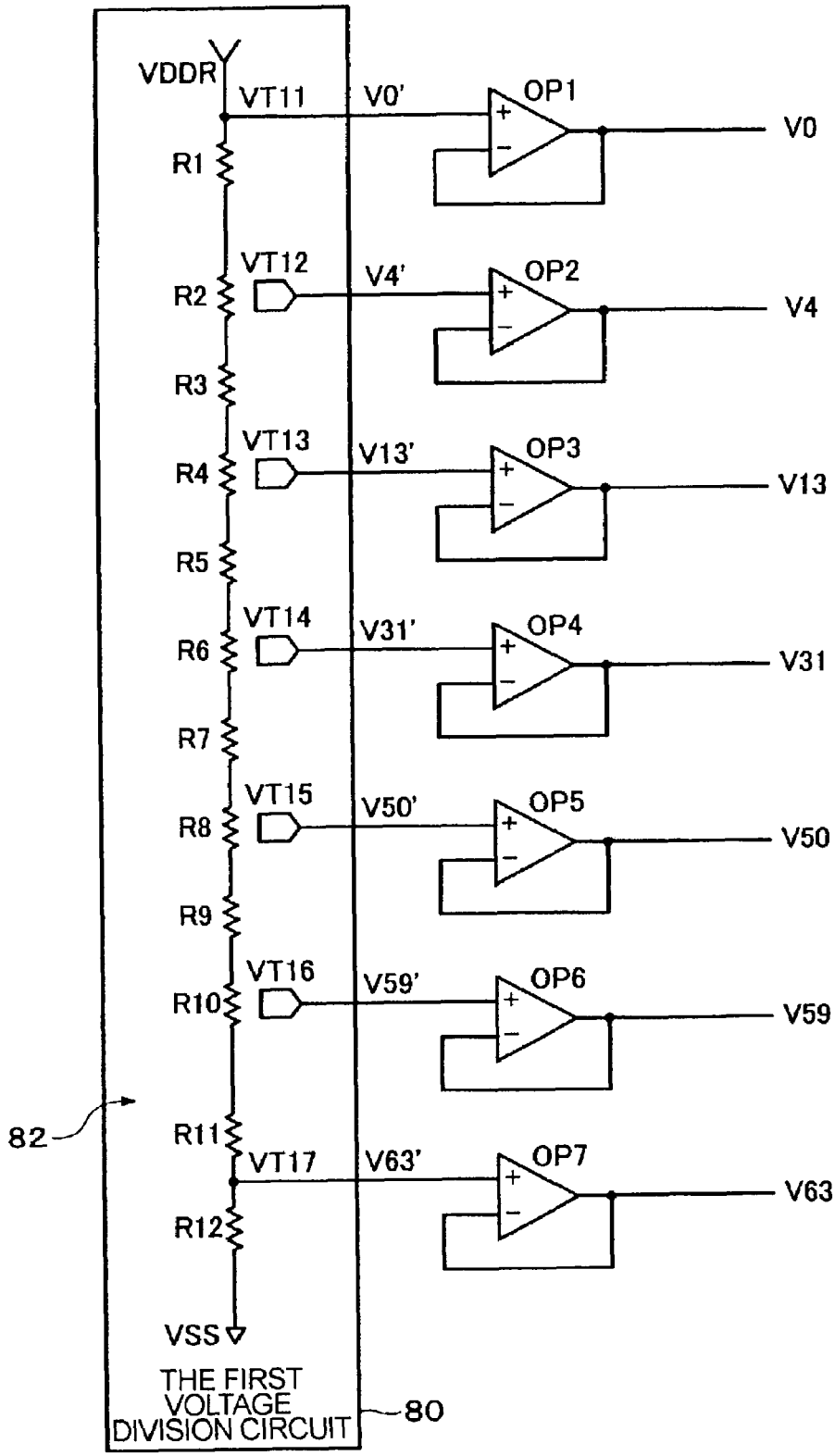
FIG. 20 is a diagram showing an example of the first voltage division circuit.

FIG. 20 shows an example of the first voltage division circuit 80.

This first voltage division circuit 80 includes a ladder resistor 82 with a plurality of resistor elements R1 to R12 connected in series between the power sources VDDR and VSS. Voltages V0', V4', V13', V31', V50', V59' and V63' are output from voltage division terminals VT11 to VT17 of the ladder resistor 82.

In FIG. 20, voltage division terminals VT12 to VT16 are voltage division terminals, which can select any taps from 8 taps of resistors R2 to R10. Any tap can be selected by setting a resistor value in a register (4 bits), for example.

Hence, various kinds of gamma correction characteristics can be obtained depending on which taps are selected.

Figure 21:
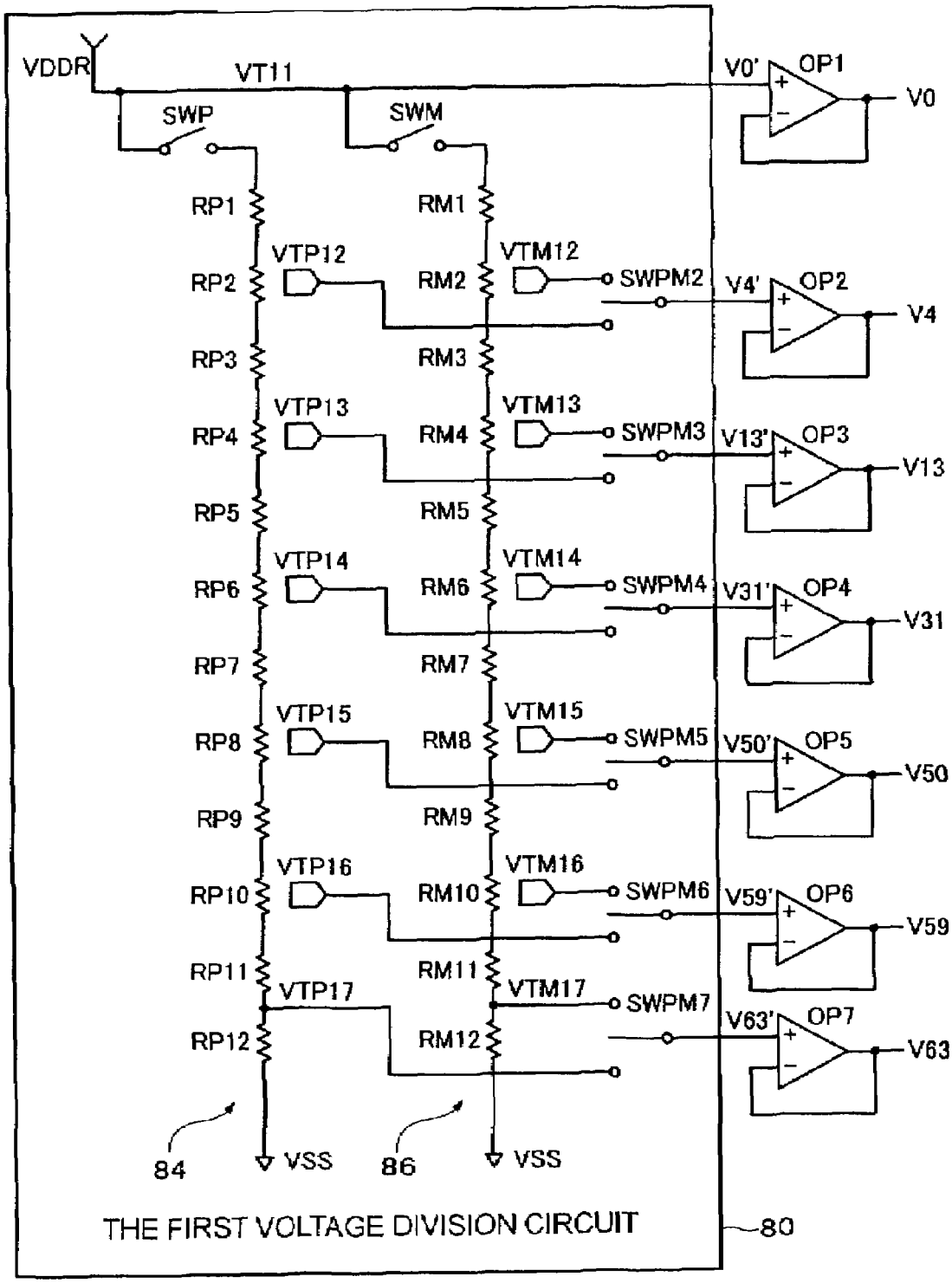
FIG. 21 is a diagram showing another example of the first voltage division circuit.

FIG. 21 shows another example of the first voltage division circuit 80.

The first voltage division circuit 80 in FIG. 21 includes a ladder resistor 84 for positive polarity, provided with resistance elements RP1 to RP12 connected in series, and a ladder resistor 86 for negative polarity, provided with resistance elements RM1 to RM12 connected in series.

The ladder resistor 84 for positive polarity is used during the period when the common voltage VCOM is the positive polarity (the period T1 in FIG. 2). On the other hand, the ladder resistor 86 for negative polarity is used during the period when the common voltage VCOM is the negative polarity (the period T2 in FIG. 2).

In detail, the switching element SWP is turned on and SWM is turned off during the positive polarity period of VCOM. In addition, a voltage of positive polarity is given to VDDR. Then, the switching elements SWPM2 to SWPM7 connect voltage division terminals VTP12 to VTP17 of the ladder resister 84 for positive polarity with input terminals of operational amplifiers OP1 to OP7.

On the other hand, during negative polarity period of VCOM, the switching element SWM is turned on, and SWP is turned off. In addition, voltage of negative polarity is given to VDDR. Then, the switching elements SWPM2 to SWPM7 connect voltage division terminals VTM12 to VTM17 of the ladder resistor 86 for negative polarity with input terminals of operational amplifiers OP1 to OP7.

In general, gamma correction characteristic (gray scale characteristic) becomes asymmetric between the period for positive polarity and the period for negative polarity of VCOM. Then, even if gamma correction characteristic becomes asymmetric, the ladder resistors 84 and 86 for positive polarity and negative polarity, are installed, shown in FIG. 21 and appropriate gamma correction, which is optimum for each of the periods for positive polarity and negative polarity, can be implemented thereby.

Figure 22:
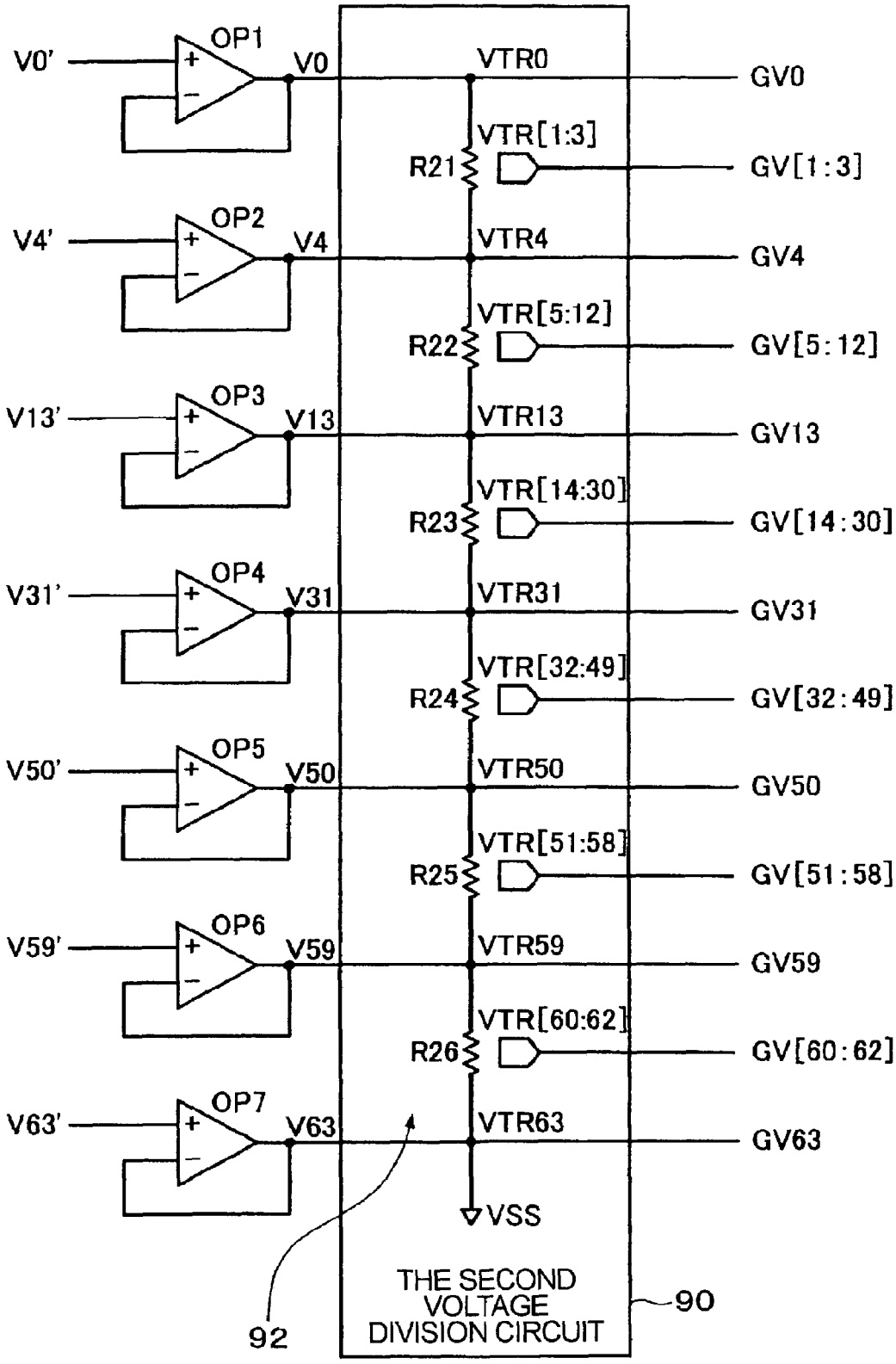
FIG. 22 is a diagram showing an example of the second voltage division circuit.

FIG. 22 shows an example of a second voltage division circuit 90.

This second voltage division circuit 90 includes a ladder resistor 92 with a plurality of resistor elements R21 to R26 connected in series. Voltage division terminals VTR0, VTR4, VTR13, VTR31, VTR50, VTR59, and VTR63 (M voltage division terminals) of the ladder resistor 92 are connected to the output terminals of the operational amplifiers OP1 to OP7. In addition, they output reference voltages GV0 to GV63 to voltage division terminals VTR0 to VTR63 of the ladder resistor 92 (N voltage division terminals).

Figure 23:
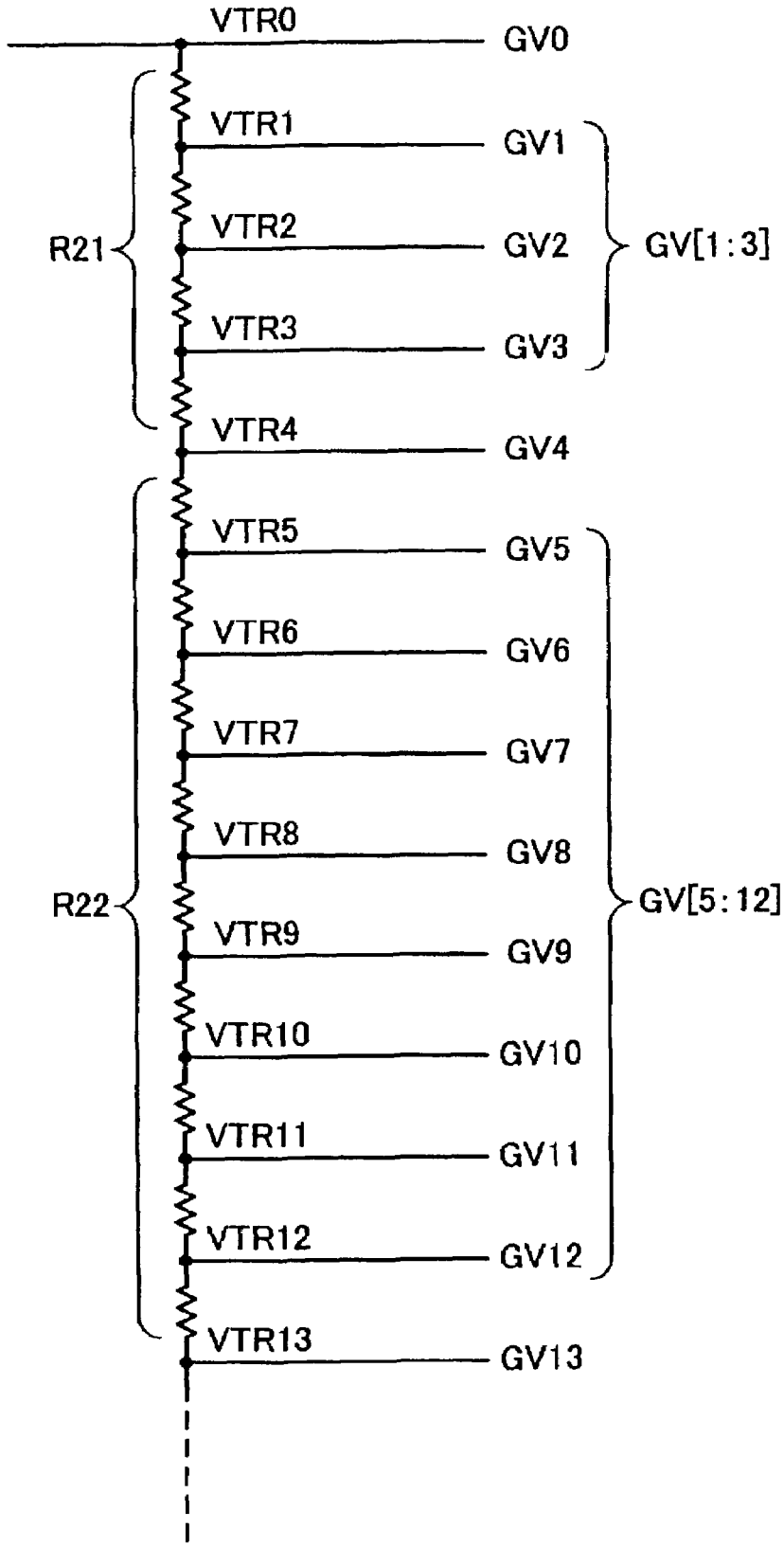
FIG. 23 is a diagram of voltage division terminals.

The voltage division terminals VTR [1:3], VTR [5:12] are obtained by dividing the resistance elements R21, R22 into further portions as shown in FIG. 23.

According to the second voltage division circuit 90 shown in FIG. 22, reference voltages GV0 to GV63 can be supplied by using operational amplifiers OP1 to OP7 having an impedance conversion function. Therefore, the output impedance of voltage division terminals VTR0 to VTR63 can be lowered. As a result, in case of removing operational amplifiers in the output circuit 40 shown in FIG. 9, it is easy to set data line voltage (pixel electrode voltage) for a desired gray scale voltage during a relatively short time.

Figure 24:
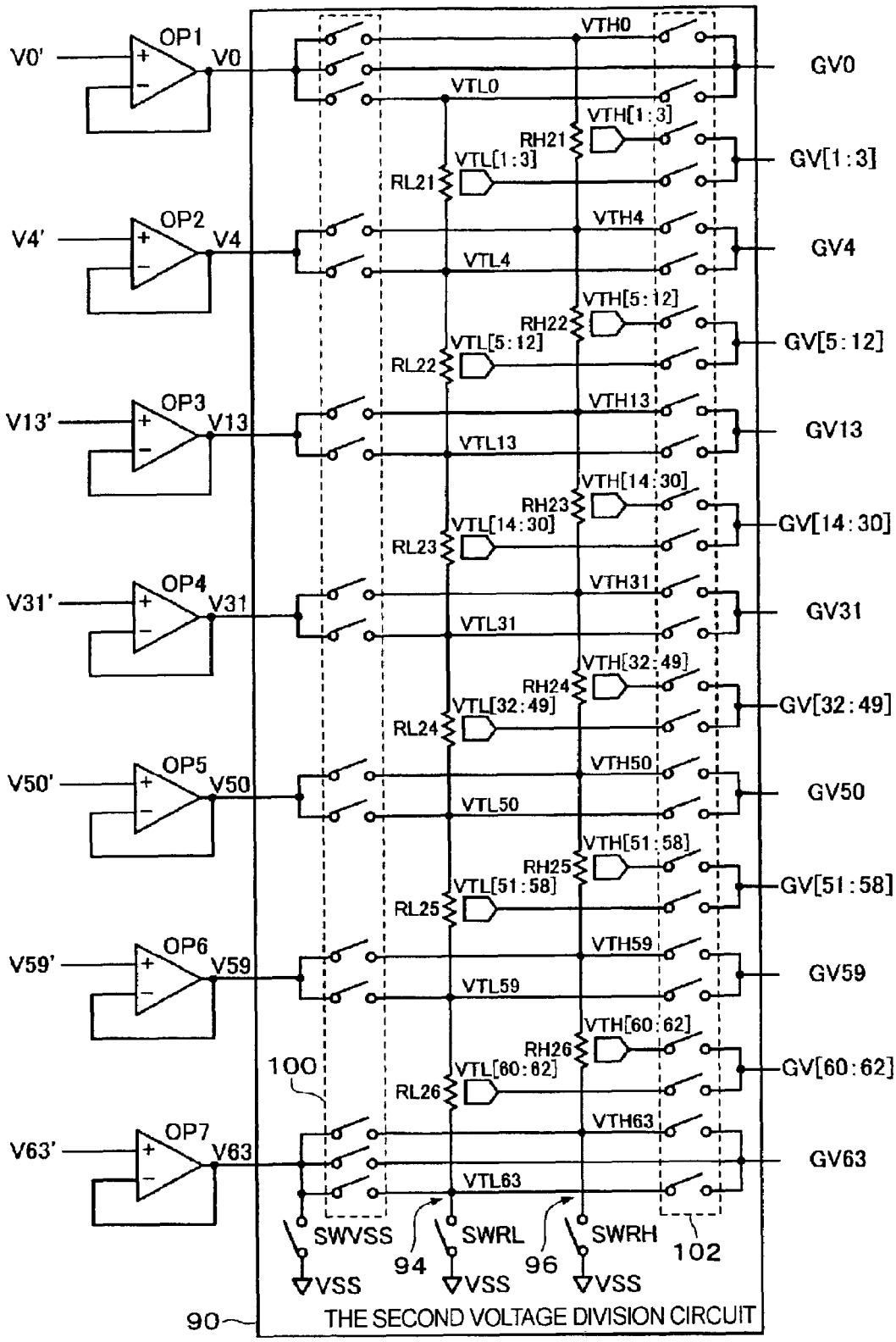
FIG. 24 is a diagram showing another example of the second voltage division circuit.

FIG. 24 shows another example of the second voltage division circuit 90.

The second voltage division circuit 90 includes a first ladder resistor 94 having relatively low resistivity (relative to the second ladder resistor, for example, 10 kΩ) with resistive elements RL21 to RL26 connected in series, and the second ladder resistor 96 having relatively high resistivity (relative to the first ladder resistor, for example, 20 kΩ) with resistive elements RH21 to RH26 connected in series.

In addition, the second voltage division circuit 90 includes the first switching portion 100 for switching resistors. This first switching portion 100 for switching resistors includes the switching element group, which connects either 7 (M) voltage division terminals VTL4, VTL13, VTL31, VTL50, VTL59, and VTL63 in the first ladder resistor 94, or 7 (M) voltage division terminals VTH0, VTH4, VTH13, VTH31, VTH50, VTH59, and VTH63 of the second ladder resistor 96 to output terminals of operational amplifiers OP1 to OP7 (impedance conversion circuits).

In addition, the second voltage division circuit 90 includes a second switching portion 102 for switching resistors. This second switching portion 102 for switching resistors includes the switching element group, which connects either 64 (N) voltage division terminals VTL0 to VTL63 in the first ladder resistor 94, or 64 pieces (N) voltage division terminals VTH0 to VTH63 in the second ladder resistor 96 to 64 (N) output terminals of reference voltages GV0 to GV63.

In addition, the first and second switching portions 100 and 102 for switching resistors include the switching elements that connect output terminals of operational amplifiers OP1 and OP7 directly to the output terminals of the reference voltages GV0 and GV63.

In addition, the switching element SWRL in FIG. 24 is turned on when the first ladder resistor 94 having relatively low resistivity is used and off when the second ladder resistor 96 having relatively high resistivity is used. On the other hand, the switching element SWRH is turned on when the second ladder resistor 96 having high resistivity is used and off when the first ladder resistor 94 having low resistivity is used. Installing these switching elements SWRL and SWRH can prevent the wasteful flow of current into the first and second ladder resistors 94 and 96 so as to attain low power consumption.

In addition, a switching element SWVSS of FIG. 24 is turned on when the voltage of a power source VSS is used as the reference voltage GV63 without using the output V63 of the operational amplifier OP7 as the reference voltage GV63.

The first ladder resistor 94 having low resistivity and the second ladder resistor 96 having high resistivity are included as shown in FIG. 24 so as to switch the first ladder resistor 94 with the second ladder resistor 96 depending on the situation. Hence, improvement of drive capability and low power consumption can be combined thereby.

Figure 25:
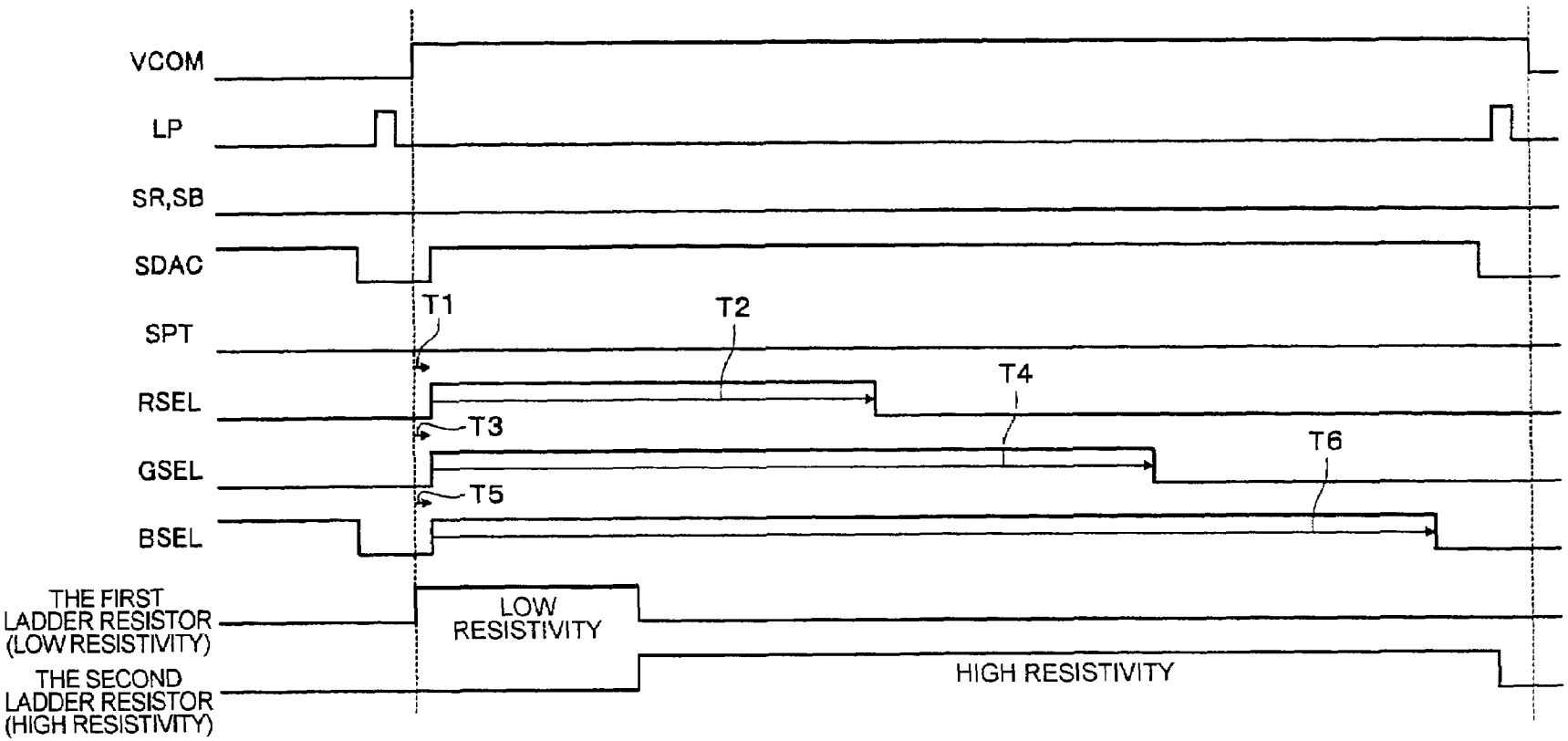
FIG. 25 is a diagram showing examples of timing waveforms for describing switching of the first and second ladder resistors.

In FIG. 25, for example, the first ladder resistor 94 having low resistivity is used during the overlapped period for periods of activating RSEL, GSEL, and BSEL (the former half of the overlapped period). On the other hand, the second ladder resistor 96 having high resistivity is used during the latter half of the overlapped period and a period after ending the overlapped period. In other words, the first ladder resistor 94 having low resistivity is used during the former half of drive period (for example, a period between the timings of changing polarity of VCOM), and the second ladder resistor 96 having high resistivity is used during the latter half of the drive period.

In detail, the first switching portion 100 for switching resistors connects 7 voltage division terminals VTL0, VTL4, VTL13, VTL31, VTL50, VTL59, and VTL63 to output terminals of operational amplifiers OP1 to OP7 during the overlap period (the former half of drive period). In addition, the second switching portion 102 for switching resistors connects 64 voltage division terminals VTL0 to VTL63 of the first ladder resistor 94 to the output terminals of the reference voltages GV0 to GV63.

On the other hand, during the latter half of the overlapped period and a period after ending the overlapped period (the latter half of drive period), the second switching portion 102 for switching resistors connects 7 voltage division terminals VTH0, VT4, VTH13, VTH31, VTH50, VTH59, and VTH63 of the second ladder resistor 96 having high resistivity to the output terminals of the operational amplifiers OP1 to OP7. In addition, the second switching portion 102 for switching resistors connects 64 voltage division terminals VTH0 to VTH63 of the second ladder resistor 96 to the output terminals of the reference voltages GV0 to GV63.

When the first ladder resistor 94 having low resistivity is used, it is advantageous in that the output impedance of the output terminals for reference voltages can be low while there is a disadvantage of increasing constant current flow into the ladder resistor. On the other hand, when the second ladder resistor 96 having high resistivity is used, it is advantageous in that constant current flow into the ladder resistor can be reduced while there is a disadvantage of high output impedance at the output terminals of reference voltages.

As shown in FIG. 25, if the first ladder resistor 94 is switched with the second ladder resistor 96, it is possible to attain minimum current flow into the ladder resistor while the output impedance of the output terminals of reference voltages can be lowered as much as possible.

Figure 26:
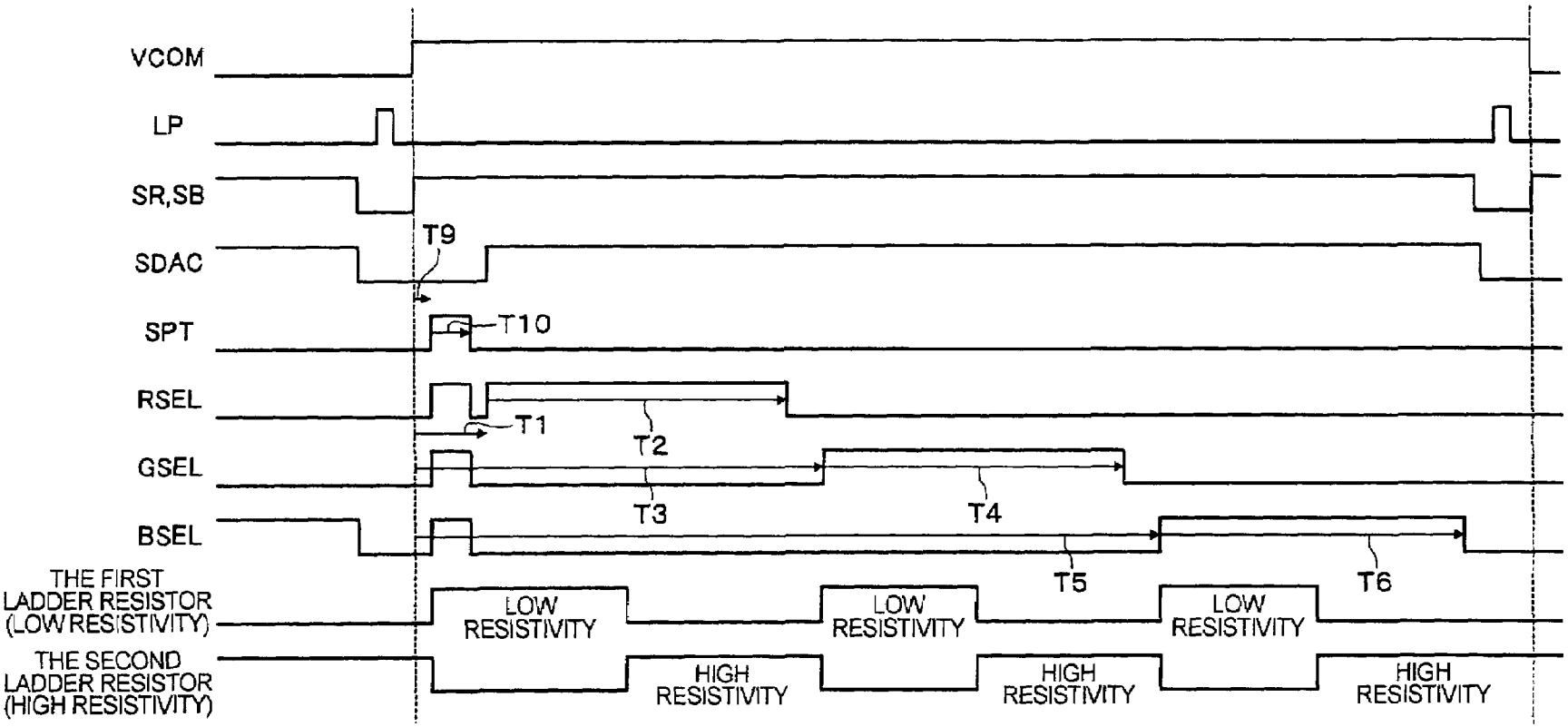
FIG. 26 is a diagram showing other examples of timing waveforms for describing switching of the first and second ladder resistors.

In addition, FIG. 26 shows another example of switching the first ladder resistor 94 with the second ladder resistor 96. In FIG. 26, the first ladder resistor 94 having low resistivity is used during the former period of activating RSEL, GSEL, and BSEL, and the second ladder resistor 96 having high resitivity is used during the latter period of activating RSEL, GSEL, and BSEL. The first ladder resistor 94 having low resistivity is used during the former period so as to enable data line voltage (pixel electrode voltage) to be close to the desired programmed voltage (grayscale voltage) during a short time. Further, the second ladder resistor 96 having high resitivity is used during the latter period so as to reduce current flowing into the ladder resistor and power consumption.

In addition, the present invention is not limited to the present embodiment and various kinds of modification can be made within the sprit of the invention.

For example, in the present embodiment, applying the drive circuit of the present invention to an active matrix liquid crystal device using TFT was described, but the present invention is not so limited. For example, the drive circuit of the present invention can be applied to a liquid crystal device other than an active matrix liquid crystal device and an electro-optical device, such as an electroluminescence (EL) device, an organic EL device and a plasma display.

In addition, the structures of the drive circuit is not limited to the structures explained in FIG. 10 to FIG. 24 and various kinds of equivalent structures can be adopted.

In addition, the present invention is not limited to drive with changing polarity every scanning line, but can be applied to other drive methods with changing polarity.

In addition, in some parts of description in the specification, the nomenclatures (operational amplifier, TFT, liquid crystal cell, liquid crystal device, R, G, B, DSWR, DSWG, DSWB, RSEL, GSEL, BSEL, MSWR, MSWG, MSWB, RMUX, GMUX, and BMUX) were cited as the nomenclatures, which are defined in a general sense as impedance conversion circuit, switching element for pixel, electro-optical material, electro-optical device, the first, second, and third color component, the first, second, and third switching elements for demultiplexing, the first, second and third switching signal for demultiplexing, the first, second, and third switching elements for multiplexing, and the first, second, and third switching signal for multiplexing. Such nomenclatures can also be replaced with nomenclatures in a general sense even in other parts of description in the specification.

What is claimed is:

1. A drive circuit for driving a display panel comprising:

a plurality of pixels;

a plurality of scanning lines;

a plurality of multiplexed data lines each transmitting data signals for one of first, second, and third color components;

a plurality of first, second, and third switching elements for demultiplexing, one end of each of the plurality of first, second, and third switching elements being connected to each of the plurality of multiplexed data lines and the other end being connected to each of the plurality of pixels for the first, second, and third color components; and a switching signal production circuit that produces first, second and third switching signals for demultiplexing, and that controls turning on and off of the plurality of first, second, and third switching elements;

the switching signal production circuit producing the first, second and third switching signals for demultiplexing to create first, second, and third activation periods, respectively, for the first, second, and third color components, respectively; the first, second, and third activation periods overlapping for an overlapped period.

2. A drive circuit claimed in claim 1, wherein the switching signal production circuit producing the first, second and third switching signals for demultiplexing so that said overlapped period is between the timing of changing the polarity of voltage applied to a pixel electrode provided with each pixel of a display panel and an opposite electrode that sandwiches electro optical material therebetween, and the timing of assuring writing of a data signal to the pixel electrode.

3. A drive circuit as in claim 1, further comprising;

a reference voltage production circuit that produces a plurality of reference voltages;

a digital to analog conversion circuit that converts digital gray scale data to analog gray scale voltage using the plurality of reference voltages;

an output circuit that outputs the analog gray scale voltage from the digital to analog conversion circuit to the data line; and the output circuit outputting a programmed voltage to the data line in the overlapped period.

4. A drive circuit claimed in claim 3, wherein;

the output circuit includes the first, second and third switching elements for multiplexing, one end of each being connected to the data line, the other end of each receiving analog gray scale voltage for the first, second and third color components, respectively, from the digital to analog conversion circuit; and the switching signal production circuit producing the first, second, and third switching signals for multiplexing to control turning the first, second and third switching elements on and off and activating at least one of the first, second, and third switching signals for multiplexing during the overlapped period.

5. A drive circuit as in claim 3, wherein;

the output circuit outputs an output voltage to the data line during the overlapped period, the phase of the output voltage being the same as the phase of the voltage applied to a pixel electrode provided with each pixel of a display panel and an opposite electrode that sandwiches electro optical material therebetween.

6. A drive circuit as in claim 5, wherein;

the output circuit includes:

the first, second and third switching elements for multiplexing, one end of each being connected to the data line, the other end of each receiving analog gray scale voltage for the first, second, and third color components, respectively, from the digital to analog conversion circuit; and first, second, and third voltage switching elements for applying voltage, one end of each receiving voltage having the same phase as voltage applied to the opposite electrode, and the other end of each being connected to the other end of each of the first, second and third switching elements for multiplexing, respectively.

7. A drive circuit as in claim 1, further comprising;

a reference voltage production circuit that produces a plurality of reference voltages;

a digital to analog conversion circuit that converts digital gray scale data into analog gray scale voltage using the plurality of reference voltages; and an output circuit that outputs analog gray scale voltage from the digital to analog conversion circuit to the data line, wherein;

the reference voltage production circuit includes:

a first voltage division circuit that includes a ladder resistor with a plurality of resistance elements connected in series, and outputs M voltages to M voltage division terminals in the ladder resistor ($M \geqq 2$); and M impedance conversion circuits that input each of the M voltages from the first voltage division circuit to each of a plurality of input terminals and output voltages for producing reference voltages to each of a plurality of output terminals.

8. A drive circuit as in claim 7, wherein, the reference voltage production circuit includes a second voltage division circuit that includes a ladder resistor with a plurality of resistive elements connected in series, and connects M voltage division terminals of the ladder resistor to the output terminals of the M impedance conversion circuits, and outputs reference voltages to reference voltage output terminals that are N ($N \geqq 2 \times M$) output voltage terminals of the ladder resistor.

9. A drive circuit as in claim 8, wherein;

the second voltage division circuit further comprises:

a first ladder resistor having low resistivity relative to a second a second ladder resistor having high resistivity relative to the first ladder resistor;

a first switching portion that switches resistors connecting either of M voltage division terminals of the first ladder resistor having low resistivity, or M voltage division terminals of the second ladder resistor having high resistivity, to the output terminals of the M impedance conversion circuits; and a second switching portion that switches resistors connecting either of N the voltage division terminals of the first ladder resistor having low resistivity, or N voltage division terminals of the second ladder resistor having high resistivity, to the N reference voltage output terminals.

10. A drive circuit as in claim 9, wherein the first switching portion for switching resistors connects M voltage division terminals of the first ladder resistor having low resistivity to M output terminals of the impedance conversion circuits during the overlapped period, and the second switching portion for switching resistors connects N voltage division terminals of the first ladder resistors having low resistivity to N output terminals of the impedance conversion circuits during the overlapped period.

11. A drive circuit as in claim 1, wherein the switching signal production circuit includes a circuit that varies at least one of the timing of activating and/or deactivating the first switching signal for demultiplexing, the timing of activating and/or deactivating the second switching signal for demultiplexing, and the timing of activating and/or deactivating the third switching signal for demultiplexing.

12. An electro optical device including a drive circuit according to claim 1, and a display panel driven by the drive circuit.

13. A method of driving a display panel including a plurality of pixels; a plurality of scanning lines; a plurality of multiplexed data lines each transmitting data signals for one of first, second, and third color components; a plurality of first, second, and third switching elements for demultiplexing, one end of each of the plurality of first, second, and third switching elements being connected to each of the plurality of multiplexed data lines and the other end being connected to each of the plurality of pixels for the first, second, and third color components; and a switching signal production circuit that produces first, second and third switching signals for demultiplexing, and that controls turning on and off of the plurality of first, second, and third switching elements; comprising:

producing the first, second, third switching signals for demultiplexing; and creating an overlapped period during the periods when the first, second and third switching signals for demultiplexing are activated.

* * * * *

UNITED STATES PATENT AND TRADEMARK OFFICE

CERTIFICATE OF CORRECTION

PATENT NO. : 7,034,797 B2
APPLICATION NO. : 10/455652
DATED : April 25, 2006
INVENTOR(S) : Katsuhiko Maki It is certified that error appears in the above-identified patent and that said Letters Patent is hereby corrected as shown below:

Column 21

Line 37, please change "a second" to --a second ladder resistors;--.

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,034,797 B2
APPLICATION NO. : 10/455652
DATED : April 25, 2006
INVENTOR(S) : Katsuhiko Maki It is certified that error appears in the above-identified patent and that said Letters Patent is hereby corrected as shown below:

Column 21

Line 37, please change "a second" to --a second ladder resistor;--.

This certificate supersedes Certificate of Correction issued August 22, 2006.

Signed and Sealed this

Ninth Day of October, 2007

JON W. DUDAS
*Director of the United States Patent and Trademark Office*